US005249517A

United States Patent [19]

Massman

[11] Patent Number: 5,249,517

[45] Date of Patent: Oct. 5, 1993

[54] LINE BUNDLING APPARATUS

[76] Inventor: Burl A. Massman, Villard, Minn. 56385

[21] Appl. No.: 980,612

[22] Filed: Nov. 20, 1992

Related U.S. Application Data

[63] Continuation-in-part of Ser. No. 902,086, Jun. 22, 1992, abandoned.

[51] Int. Cl.[5] ..... B65B 57/16; B65B 57/08

[52] U.S. Cl. ..... 100/4; 53/138.2; 100/17; 100/30; 100/32; 100/33 R

[58] Field of Search ..... 53/138.2, 139.4; 100/4, 100/7, 18, 19 R, 20-23, 29, 30, 32, 33 R

[56] References Cited

U.S. PATENT DOCUMENTS

| | | | |
|---|---|---|---|
| D. 220,001 | 2/1971 | Mills | D15/145 |
| 2,052,627 | 9/1936 | Hermann | 100/17 |
| 2,088,133 | 7/1937 | Evans | 100/31 X |
| 2,596,862 | 5/1952 | Mirfield | 100/29 X |
| 3,001,346 | 9/1961 | Kiwi | 53/138.2 |
| 3,104,606 | 9/1963 | Kerrigan | 100/30 X |
| 3,114,308 | 12/1963 | Saxton et al. | 100/4 |
| 3,247,781 | 4/1966 | Meckler | 100/27 |
| 3,489,076 | 1/1970 | Countryman | 100/4 |
| 3,820,451 | 6/1974 | Tanaka | 100/30 X |
| 4,527,379 | 7/1985 | Bartzick et al. | 100/29 X |

FOREIGN PATENT DOCUMENTS

| | | | |
|---|---|---|---|
| 1378851 | 10/1964 | France | 100/17 |

*Primary Examiner*—Stephen F. Gerrity
*Attorney, Agent, or Firm*—Donald A. Jacobson

[57] ABSTRACT

This pneumatic operated and controlled machine secures a line about nursery stock placed upon a table top to form a bundle. The line is fed from a source through an upper mechanism comprising a tensioner arranged to hold the line with a predetermined force, through a dancer arm arranged to tighten the line, and through a needle into a slot in the table top where the line end is gripped by a lower mechanism. The dancer arm pulls against the tensioner to draw the stock into a compact bundle. In a second embodiment a powered drum provides additional line tension for the upper mechanism. The needle wraps the line, the end of which the lower mechanism had gripped on the previous cycle, around the nursery stock and back into the slot, where both line ends around the bundle are adjacent to each other. The lower mechanism then pulls upon both line ends to further tighten the bundle, grips the lines, secures the lines together with a metal clip, and finally cuts the lines to free the bundle.

19 Claims, 14 Drawing Sheets

A
30
117
32
110
116
112
114
108
104
111
102
106
36
74
88
18A
18
69
81
100
26
70
72
88A 113
115

LINE BUNDLING APPARATUS

This application is a continuation of application Ser. No. 07/902,086, filed Jun. 22, 1992 (abandoned).

FIELD OF THE INVENTION

This invention relates to apparatus arranged to wrap a line around nursery stock, and secure the line with a metal clip in order to form a bundle.

BACKGROUND OF THE INVENTION

There are existing apparatus which can secure flexible material around a variety of individual items to form a bundle.

In Mirfield, U.S. Pat. No. 2,596,862 pipes, tubes and the like can be bundled together by welding the ends together. In Countryman, U.S. Pat. No. 3,489,076 apparatus automatically straps a bundle of cables together by a closure member which holds the ends together. In Evans, U.S. Pat. No. 2,088,133 wire can be wrapped and secured around a box by welding.

In Mecker, U.S. Pat. No. 3,247,781, an automatic machine for tying or bailing uses a ring to place the tying material tightly around a package.

In Mills, U.S. Pat. Des. 220,001 and Des. 220,210 illustrate a curved arm which is pivotally mounted above an opening in a table top.

In Bartzich et al U.S. Pat. No. 4,527,379 apparatus for positioning and tensioning a plastic strapping band around a package and connecting the overlapping ends by not bonding is described.

A side binder nursery tyer Model BMNS manufactured by the Saxmayer company teaches the use of an arcuate needle to wrap a line around nursery stock being held by an operator which ties the ends of the line into a knot to secure the nursery stock into a bundle.

None of these previous inventions recognize or teaches: the use of a clip to attach the ends of a line about stock to form a bundle, the use of a dancer arm and air motor to pull the line tight before attachment, the further tightening of the lines around the bundle before the attachment of the clip to further compact the bundle, the use of a multi-element gripper to grip the end of the line securely after tightening and before clip attachment to securely grip the lines as the clip is being attached, or the use of pneumatic logic to coordinate the operations.

SUMMARY OF THE INVENTION

This nursery stock tier apparatus will automatically form a bundle from a quantity of nursery stock placed upon a table, by using a clip to secure a flexible line about the stock. In operation the line extends from a supply box, through an upper apparatus mounted above the table top comprising a tensioner arranged to grip the line until a predetermined force is applied, through a pivoted dancer arm, which is arranged to pull against the line from the tensioner for tight bundle, through a hole in the free end of a rotated arquate needle arranged to wrap the line about the nursery stock, and finally through a slot in the table top where the end of the line is gripped by a lower apparatus.

A second embodiment of the upper apparatus adds a tension assist mechanism, which uses a drum powered by an air motor attached to the line between the tensioner and the dancer arm, to generate additional line tension for a tighter bundle wrap.

In the first part of the bundling operation, the needle of the upper apparatus wraps line from the supply box tightly about a quantity of nursery stock and pulls the line into the slot in the table top, while the lower apparatus holds the end of the line. After the needle has pulled the line tightly about the bundle, the lower apparatus then pulls on the two ends of the line wrapped about the bundle to further tighten the bundle, wraps a metal clip tightly about these two line ends to secure the lines, grips the two line ends in preparation for the next cycle, and cuts the line ends between the clip and the gripped portion to free the bundle.

The arcuate needle of the upper apparatus has one end attached to a driven axle. The axle is mounted horizontally above the table top and perpendicular to the front edge. The needle is positioned and arranged such that it will oscillate over the canter of the table, from a first position with the free end above the axle, to a second position with the free end inserted into the slot in the table. With this arrangement the free end of the needle will carry the line around the bundle and into the slot.

When the needle is in the first position, the line from the gripped end in the slot will extend perpendicularly to the needle end. An operator manually places nursery stock upon the table top under the needle, oriented generally parallel to the needle axis, and on the side of the line such that, as the needle oscillates from the first to the second position, the line will be wrapped around the stock. The needle axle is driven by two double-acting pistons extending from cross-connected pneumatically powered cylinders attached to the end of the axle opposite the needle.

The dancer arm is driven by a short extension, extending from the needle axle adjacent to the needle, which acts upon the dancer arm through a chain and a spring. As the axle drives the needle from the first to the second position, this extension will power the dancer arm to carry the line upward away from the table top to maintain tension upon the line. When the end of the needle has carried the line to the second position, extending through the slot in the table top, the two ends of the line wrapped around the stock will be positioned parallel and proximate to one another ready for further operations by the lower mechanism.

A second embodiment adds an air motor driving a drum, with the air motor and drum attached to the end of the needle axle adjacent to the needle to assist in providing more line tension. The line engages the drum between the tensioner and the dancer arm. The air motor is powered by the same pneumatic lines that drive the needle axle to rotate the drum at the same time as the axle. The pneumatic lines are connected such as to drive the drum in the direction which will assist the dancer arm in tightening the bundle.

The lower apparatus is positioned below the table top adjacent to the slot. This lower apparatus is operated by a slide and is driven parallel to the table top by a third double-acting pneumatically powered piston. This slide operates all the lower apparatus operations, which are automatically coordinated by being driven by the one slide.

After the needle has been rotated to the second position, where the free end of the needle extends downward from the table top past the lower apparatus, the third piston is then extended. The lower apparatus has a generally cylindrical shaped capture disk with eight identical inwardly extending cut-outs spaced equally around the periphery. The capture disk has a center hub which is mounted over a hollow axle attached perpendicular to the table top. A projection from the slide bears against and rotates a spring loaded prawl. The end of the prawl is arranged to engage one of the capture disk cut-outs to rotate the capture disk. The capture disk is rotated exactly one-eighth of a rotation by the prawl for each full extension of the slide, such that a cut-out is always aligned with the cut-out at the end of each rotation cycle.

After the needle has been rotated to the second position, but before the slide has been extended, the ends of the line wrapped about the bundle extend through a slit in the periphery of the lower apparatus aligned with the slot into an aligned cut-out. The gripped line end was pulled into the cut-out by the needle as it rotated upward at the end of the previous cycle. The other line and was wrapped around the bundle, carried into the slit, and pulled into the aligned cut-out on the current operating cycle by the oscillation of the needle from the first to the second position. Both of these line ends extending around the bundle are generally perpendicular to the table top, positioned within the aligned cut-out, and parallel to one other.

When the prawl rotates the capture disk after the needle oscillation has carried the second line end into the cut-out the two line ends are pulled and tightened by this rotation to further compact the bundle. The capture disk is made up of three disk shaped individual disk elements each having cut-outs aligned with each other and attached to the hub having gaps between them. As the capture disk completes its one-eight revolution, the two line ends are forced against extensions from a locking mechanism. These extensions are sized and aligned to fit between the gaps between the individual capture disk elements and force the lines into these gaps. When the lines are forced between the extensions and the capture disk elements they are gripped tightly between them.

A punch attached to the slide is also driven by this same slide extension towards the two lines. The punch first picks up an open U-shaped clip from the end of a stack of clips, positions the open end of the clip around the lines, and forces the clip against an anvil which turns the clip ends back tightly around the lines to form a bundle.

The slide is then retracted. A pivotally mounted blade with a return spring is mounted between the capture-disk and the table top. The slide has a projection which engages the blade at the beginning of the slide return to rotate the blade. The blade is oriented to rotate in plane parallel to the table top, and located such as to intersect and cut the two lines between the clip and the capture-disk on the beginning of the slide return to free the bundle. As the slide continues its return, the projection disengages from the blade to permit the spring to return the blade to the original position for the next cycle.

After the two ends of the line extending around the bundle are cut, the portion of the lines extending in the opposite direction to the table top are still gripped between the capture disk and lock mechanism. The line end, which was gripped by the capture disk on the previous cycle, after being cut becomes a short line segment extending from the capture disk to the cutting plane of the blade. The other gripped line end, which extends from the capture disk to the needle end, after being cut becomes the new line end for the next cycle.

After the slide has completed its return, the needle is then rotated from the second position back to the first position to complete the bundling cycle. This rotation of the needle pulls the line from the newly gripped line end upward through the capture disk cut-out, which has just moved into alignment with the slit by the last one-eighth rotation of the capture disk. On the return to the first position, the needle pulls additional line from the supply box through the tensioner, because the needle can exert more force than the tensioner and air motor drum, which also returns the dancer arm to its original position near the needle.

The secured bundle, freed when the blade cut the two line ends, is then removed by the operator who places more nursery stock on the table top and initiates the next cycle. The aligned capture disk cut-out, which received the line f rom the needle end on the needle return, will again receive the line end carried by the needle around the nursery stock and downward through the slot on the next cycle. After the capture disk is again rotated at the end of the next cycle the two line ends, which were gripped by the disk and lock mechanism on the previous cycle, will be released as the disk is again rotated one-eight of a revolution, which moves these line ends away from the locking extensions. As before, the line end from the bundle, which was the end of the line for the current cycle, is cut at the end of the cycle to become the new short line segment. The end of the short line segment, which was gripped on only one end by the disk mechanism and locking mechanism on the previous cycle, will be released by this second rotation of the capture disk at the end of the current cycle, as will one end of the newest short line segment. The opposite end of this newest short segment will still be held with the current line end.

Since the short line segment from the previous cycle has now had both ends released, this segment could jam the mechanism. Air under pressure, obtained from the exhaust side of the third cylinder driving the slide, is directed outward from the disk cut-out at the release point, where the second end of the short line segment is released, to eject this released short line segment.

In order to wrap the line around the bundle the line end must be gripped before the needle is rotated from the first to the second position, and since the line is gripped by the operation of the lower apparatus after the needle is rotated, the apparatus must be "primed" by being operated for one cycle without nursery stock to grip the line end only. Once the end of the line is gripped, no further "priming" is required as long as the line feed is continuous.

An operator need only step on a foot operated pneumatic switch to cause all of the bundling operations to be performed automatically and in the proper sequence. Pneumatic control logic, which perform logic operations essentially identical to electronic control logic, is used to provide the proper sequence and timing of the operations. The control logic uses information from pneumatic switches located at the end points of the slide to determine the slide end points, and a pneumatic switch adjacent to one of the rods driving the needle to determine the second position of the needle oscillation. The control logic delays the operation of the slide until after the needle is rotated to the second position before the slide is operated.

An emergency stop switch is provided, which operates upon the control logic. The operator can set this stop switch at any time to completely stop the operation of the system at any point in the operating cycle. The stop switch must reset to restart the operation.

A second needle can be attached to the same axle as that carrying the first needle, along with all related upper and lower apparatus, a second table top slot, and related pneumatic logic would permit attaching two lines about a single bundle simultaneously. The power for the rotation of the second needle is provided by the axle driving the first needle, while an additional cylinder is provided as part of the additional lower apparatus. This same approach can be extended to secure additional lines about the bundle.

DETAILED DESCRIPTION OF THE PREFERRED EMBODIMENT

Apparatus Overview

Figure 1:
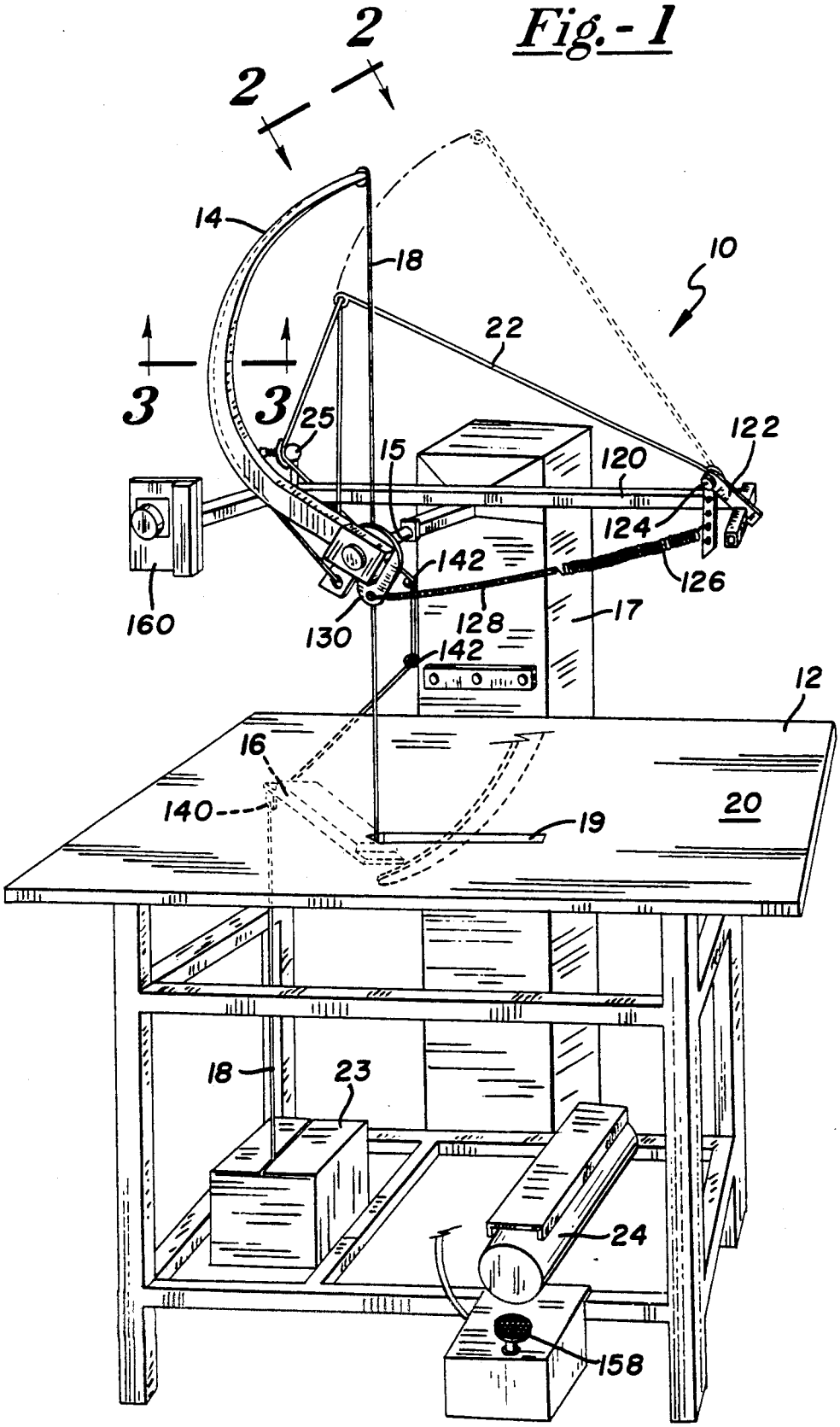
FIG. 1 is an apparatus isometric view with the two positions of the dancer arm shown in solid outline and dashed outline and with one position of the needle shown in solid outline and a second position of the and of the needle shown in dashed outline.
Figure 2:
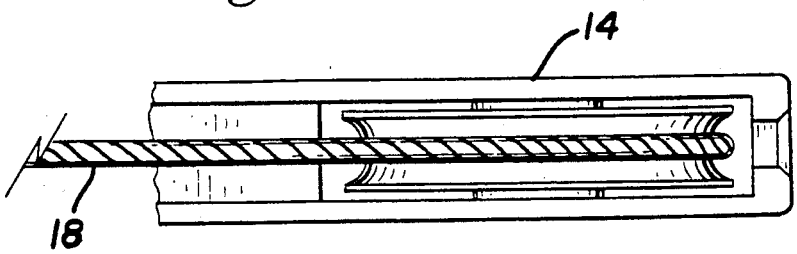
FIG. 2 is a detail view of end of needle taken along 2—2 of FIG. 1.
Figure 3:
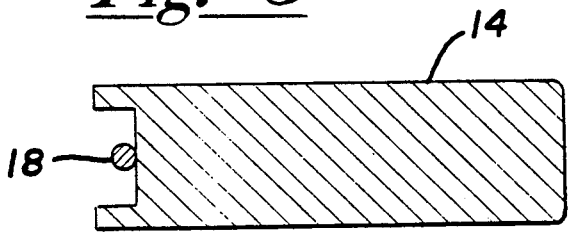
FIG. 3 is a cross-section of needle taken from 3—3 of FIG. 1.

An overview of nursery stock tier upper apparatus 10 is shown in FIG. 1. Nursery stock to be tied together is placed upon table 12. Needle 14 is fixed on the end of a pivotally mounted horizontal axle 15 mounted above table top 20 from tower 17 with lower apparatus 16 is mounted underneath. Line 18 is fed from a supply box 23 through guides 142 to a tensioner 25, which provides a predetermined grip on the line, through a closed loop formed in the end of dancer arm 22, which pulls against the line to keep tension on the line, and last around a pulley in needle 14 and an elongated hole in its end. This path of line 18 around needle 14 is through a groove in the outside curve of the needle, shown in detail in FIG. 3, over an idler pulley mounted in an elongated hole at the end of the needle, shown in detail in FIG. 2, and finally through the elongated hole. Line 18 from needle 14 then enters slot 19. The oscillation of arcuate needle 14 from an upper counter-clockwise position above axle 15, shown in solid outline, to a clockwise position with the needle end extending through slot 19 in table top 20 below lower apparatus 16, shown in dashed outline, carries line 18 downward into the slot below the lower apparatus. The end of line 18 extending into slot 19 is gripped by lower apparatus 16 while the upper apparatus operates upon the line. Nursery stock is placed over slot 19 generally perpendicular to the front edge of table top 20 to be encircled by line 18 by the rotation of needle 14. Lower apparatus 16 then performs further operations upon the line which are described later.

Pneumatic power operates the nursery bundler apparatus 10. A storage tank 24 contains air under pressure for distribution to a pneumatic system to power the apparatus. Storage tank 24 is charged in a shop and operated in a field with no other power being required, since both the mechanical apparatus and the controls are operated pneumatically. The operation of the pneumatic system and controls will be described later.

Lower Apparatus Overview

Figure 8:
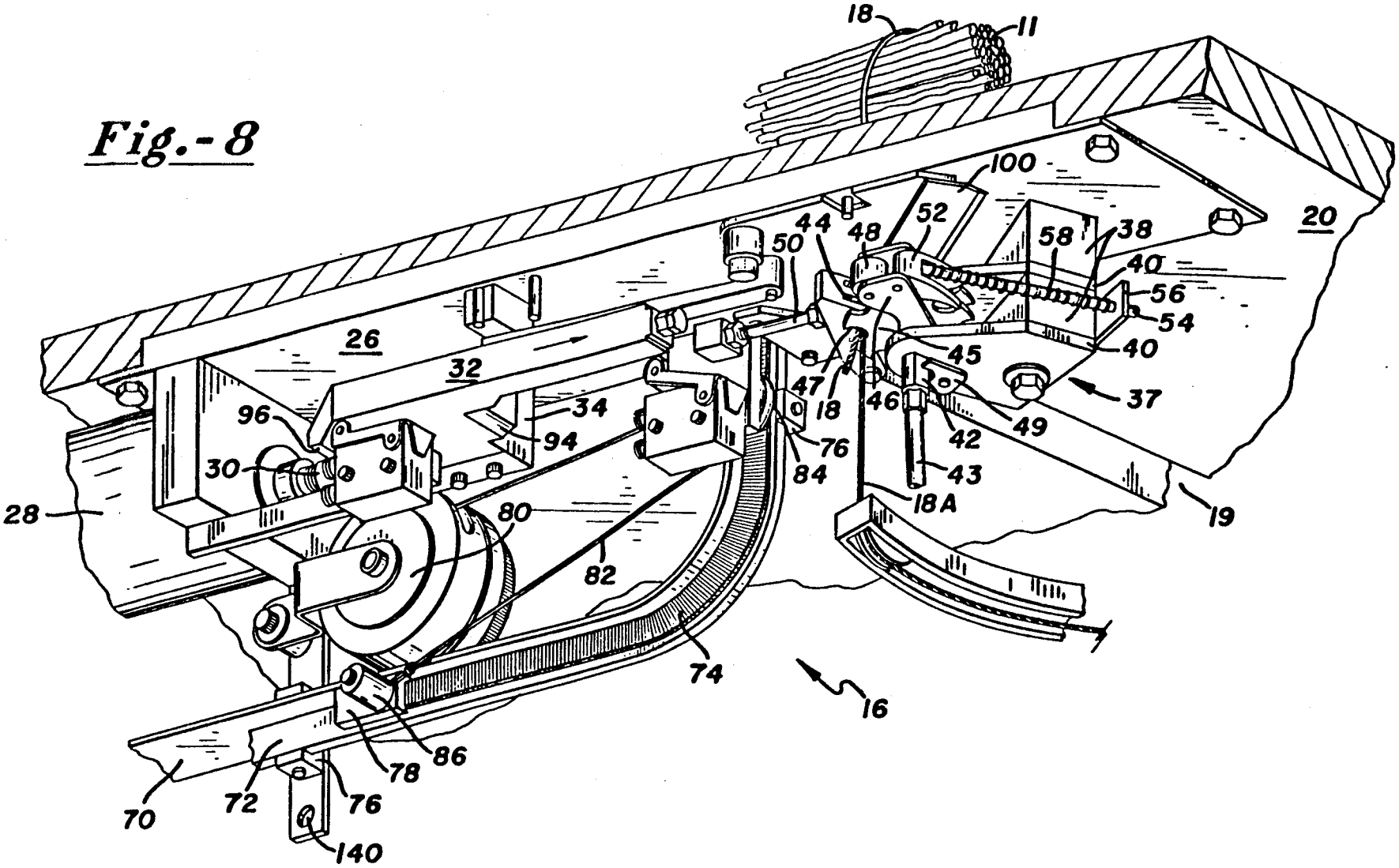
FIG. 8 is an isometric view of lower apparatus and the adjacent table top.

Lower apparatus 16 is shown in FIG. 8. Here lower apparatus 16 has gripped both ends of line 18 and 18A extending around nursery stock 11. Lower apparatus 16 performs the functions of pulling against the ends of lines 18 and **18*a*** extending around the bundle, gripping these lines, clipping the lines together with a metal clip, and cutting the lines to free the bundle. These operations are described in detail later.

Lower apparatus 16 has a base 26 having corner mounting holes. The central portion of base 26 located between these extensions is secured within a mating recess in table top 20 by bolts through each corner mounting hole secured into mating threaded holes in the table top.

Cylinder 28 provides the power for lower apparatus 16. Extending from cylinder 28 is rod 30, which extends from a double acting piston within the cylinder. Air pressure supplied to the left end of cylinder 28 will drive rod 30 outward and air pressure supplied to the right end of the cylinder will drive the rod inward. The control of this operation will be explained as a part of the pneumatic logic. Rod 30 is connected to a slide 32 which in turn is attached to a vertical slide member 34. Slide 32 is driven by rod 30 to provide all of the operations of lower apparatus 16.

A punch attached to vertical slide member 34 slides within a grove in base 26 parallel to rod 30. The punch and groove are not shown in this figure but will be described further later.

Lower Apparatus, Capture Disk and Locking Mechanism

As shown in FIG. 8, a support member 37, made up of vertical support members 38 interleaved with horizontal support members 40, is bolted to base 26 by a bolt secured within a mating threaded hole in the base which extends through aligned holes in the support members. A hollow axle 42 is mounted vertically through mating aligned holes in the ends of horizontal support members 40. The outer end of hollow axle 42 has opposed flat sides and the opposite end of the axle is blocked. An air hose 43 is connected to the outer and of hollow axle 42 from the exhausts of cylinder 28 to eject short line segments, as will be described later. Bifurcated clamp 49, which is shaped to fit around the outer end of axle 42, is bolted to the outermost horizontal support member 40 and brackets the end of the axle. This orients axle 42 at a particular angle with respect to base 26. The reason for this will be described as part of the short line ejection apparatus.

Capture disk 44 is made up of a set of three individual disks 45 which are attached to a hub. The hub of capture disk 44 is pivotally mounted over hollow axle 42. Individual disks 45 are spaced equally from each other on the hub. Each individual disk 45 has eight partial circular cut-outs 47 spaced equally around its periphery. The cutouts 47 of the all three individual discs 45 being aligned with each other.

A pair of plates 46, which bracket capture disk 44, are also pivotally mounted on axle 42. A roller 48 is pivotally mounted between plates 46 on a pin extending therebetween. An adjustable extension 50, consisting of a bolt threaded into a mating hole in slide 32, bears against roller 48 as slide 32 moves outward from cylinder 28 to cause plates 46 to rotate about axle 42 in a clockwise direction, as shown in this figure. Adjustable extension 50 permits adjusting the end rotation position of the capture disk 44. Roller 48 minimizes the friction between slide extension 50 and plates 46.

A prawl 52 is pivotally mounted between plates 46 on a second pin also extending between the plates. A slot in prawl 52 is wider than push rod 54, such that the push rod can rotate within the slot. Prawl 52 has a recess within the slot adjacent to the second pivot pin which is slightly nearer axle 42 than the pin, sized and arranged to hold one end of push rod 54, such that with the end of the push rod secured within this recess but with the push rod free to pivot over a limited range.

The opposite end of prawl 52 is shaped to engage any opposed cut-outs 47 of capture disk 44. A tab 56 having a hole large enough to slidably receive push rod 54 encloses the end of the push rod. Tab 56 is mounted on outer vertical support member 38. A coil spring 58, is mounted over rod 54 between tab 56 and prawl 52. Coil spring 58 is dimensioned to bear against both tab 56 and prawl 52. Spring 58 forces the shaped free and of prawl 52 inward to engage the opposed cut-outs 47 of individual disks 45. The end of plates 46 opposite to roller 26 bears against support member 37 to limit the counter-clockwise rotation of the plates counter-clockwise to the amount shown in this figure.

When slide 32 is moved outward with the end of prawl 52 engaging a cut-out 47, then extension 50 will act on plates 46 through roller 48 and cause capture disk 44 to rotate clockwise as shown in this figure.

Figure 11:
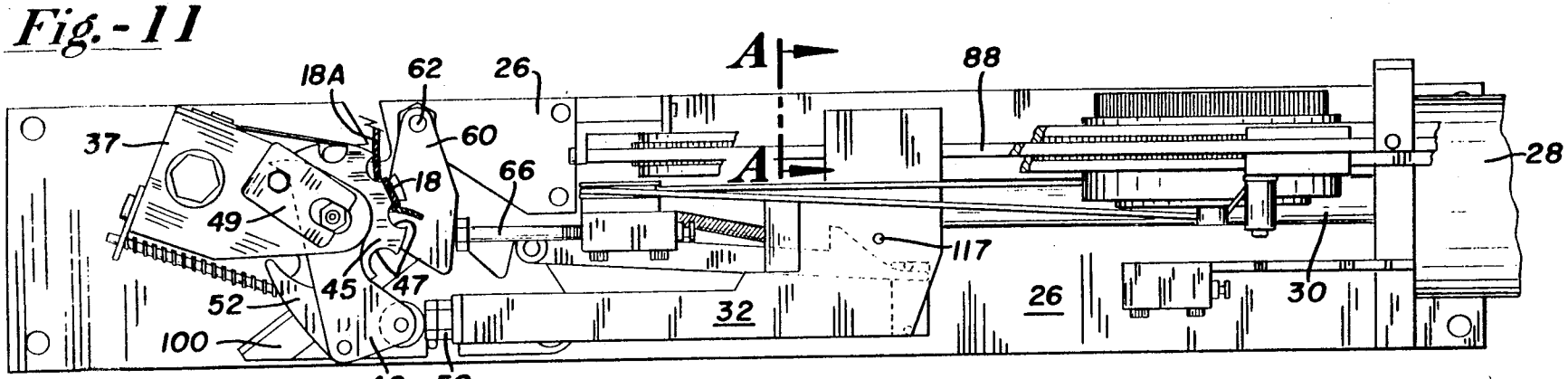
FIG. 11 is a plan view of lower apparatus with the slide retracted.
Figure 12:
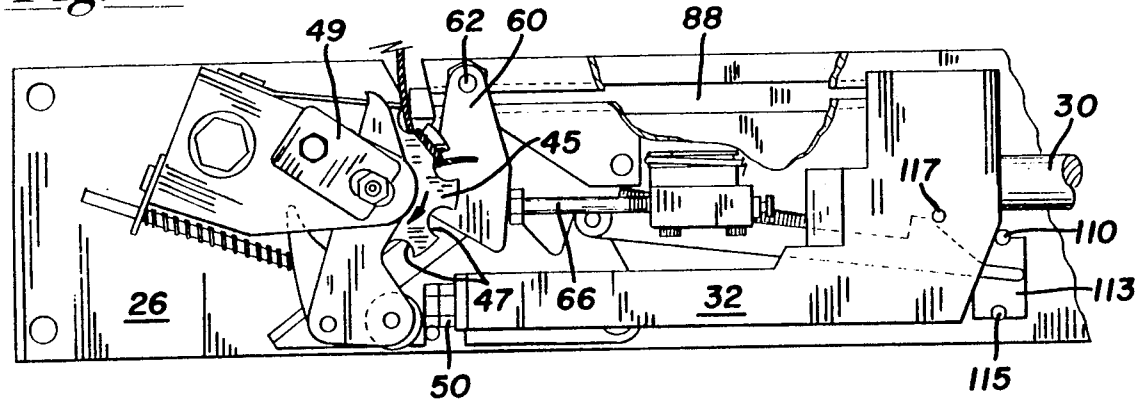
FIG. 12 is a plan view of lower apparatus with the slide extended.

This operation is shown in FIGS. 11 and 12. In FIG. 11, rod 30 is withdrawn into cylinder 28, while in FIG. 12 rod 30 is extended. The dimensions of the parts are made such that the motion of slide 32 from the fully withdrawn to the fully extended position will cause prawl 52 to rotate capture disk 44 the distance between adjacent cut-outs or one-eighth of a turn clockwise.

Figure 10:
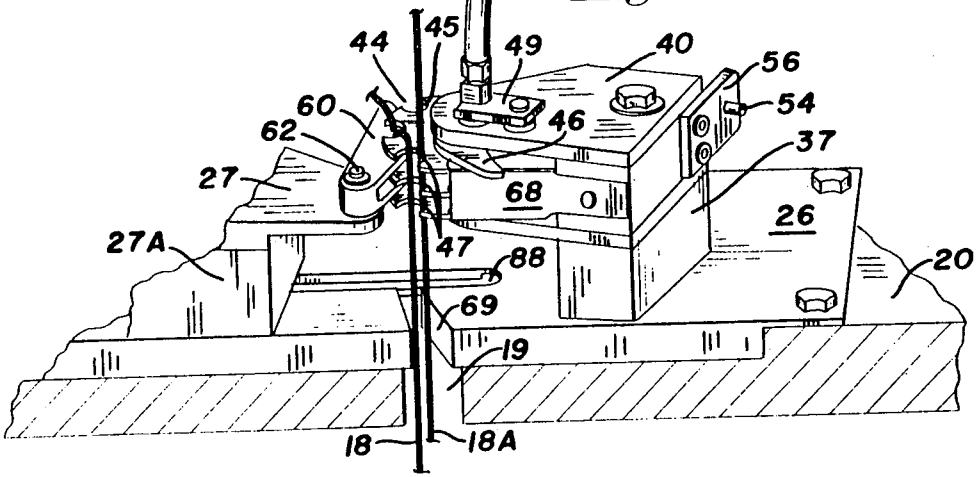
FIG. 10 is an isometric view of the capture disk and adjacent portions of the lower apparatus and table top.
Figure 20:
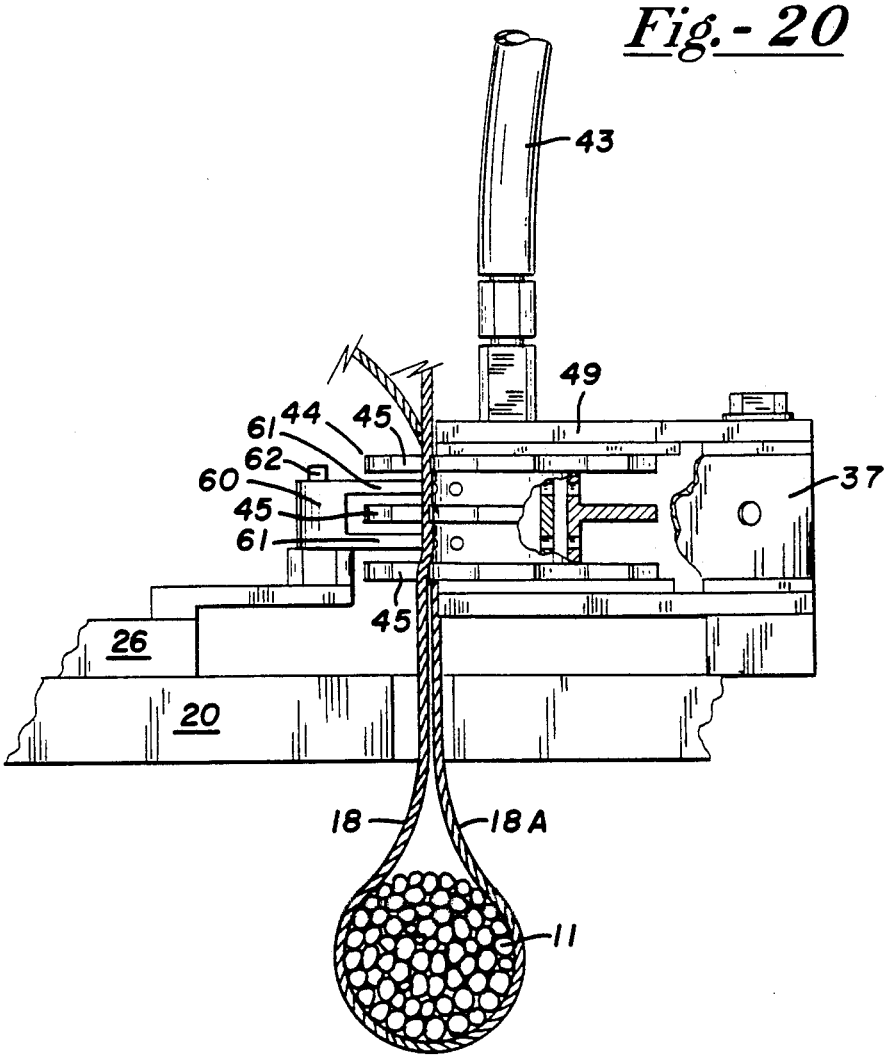
FIG. 20 is a side view of capture disk gripping lines about a bundle.

In FIGS. 10 and 20, lines 18 and 18A are shown positioned within aligned cut-outs 47 of individual disks 45 of capture disk 44. Lines 18 and 18A are opposite ands of a line wrapped around bundle 11.

Individual disks 45 are spaced far enough apart that two extensions 61 from locking mechanism 60 can fit between the three spaced apart individual disks to grip lines 18 and 18A between them, after capture disk 44 has been rotated one-eighth of a turn to carry these lines opposite the locking extensions. Since lines 18 and 18A are always gripped in pairs, all subsequent rotations of capture disk 44 will operate upon a pair of lines rather than just a single line.

Figure 9:
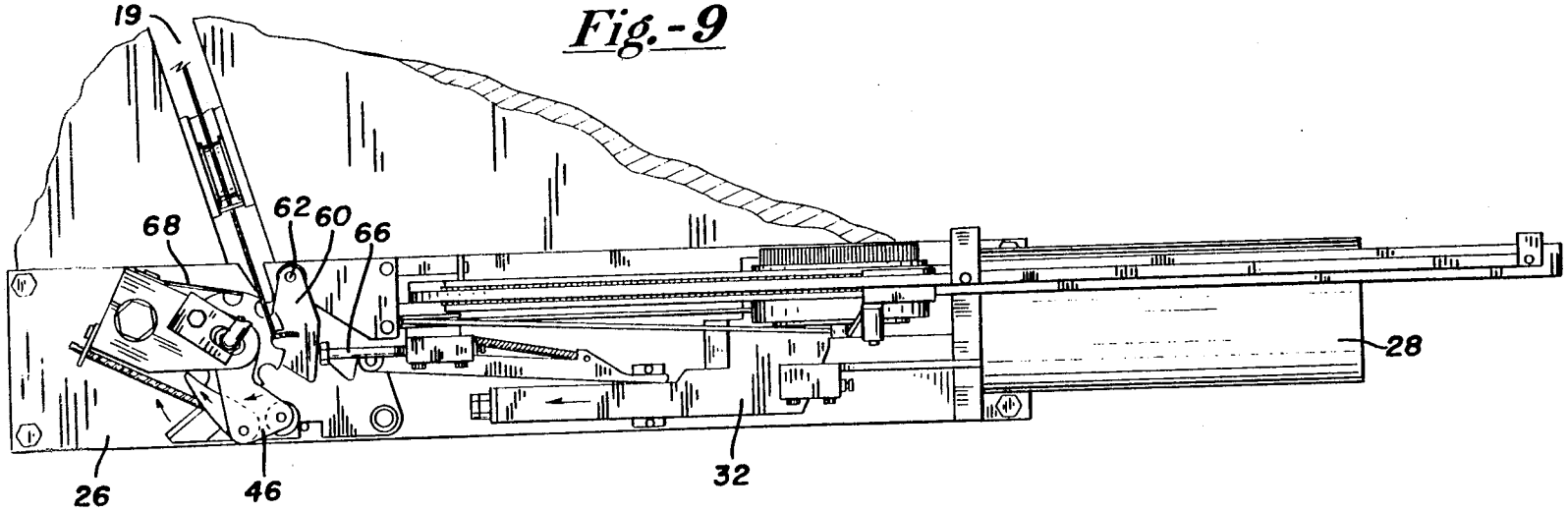
FIG. 9 is a plan view of lower apparatus with slide extended.

As shown in FIG. 10, locking mechanism 60 is pivotally mounted on pin 62, extending through intermediate part 27 which is attached to part 27A, which are attached to each other and to base 26. As shown in FIG. 9 an adjustable stop 66, attached to base 26 through an intermediate part, prevents locking mechanism 60 from rotating any further counter-clockwise than is shown here. Adjustable stop 66, consisting of a bolt threaded into the intermediate part extending from base 26, provides an adjusting means for the amount that extensions 61 can extend within and between individual disks 45 which provides a gripping force adjustment.

As also shown in FIG. 10, a flat spring 68 located on the side of support member 37 opposite rod 54 is attached by a bolt through a mating hole in the spring into a threaded hole in the side of the support member. Flat spring 68 rides upon the outer edges of individual disks 45 such that the end of the flat spring will be urged into any opposite set of disk openings 47. Since the disk openings 47 are all aligned, flat spring 68 will engage all three aligned disk openings simultaneously. Flat spring 68 acts as a lock, to prevent capture disk 44 from rotating counter-clockwise but to allow it to rotate clockwise, by bearing against the inner opposed edge of disk openings 47. Flat spring 68 is located such that this locking action occurs at the end of each full extension of slide 32. Flat spring 68 holds capture disk 44 firmly against the horizontal extensions of locking mechanism 60 to maintain a grip on lines 18 and 18A.

Slit 69 in base 26, shown in FIG. 10, is aligned with slot 19 on one side and opens into channel 88 opposite the edge of capture disk 44. Channel 88 also contains and directs the punch. The operation of the punch will be described later. Line 18 was gripped by locking mechanism 60 on the previous cycle and pulled through slot 19 and slit 69, into channel 88 opposite an aligned cut-out 47. On the next clockwise oscillation of needle 14 line 18 was pulled around bundle 11 back into slot 19 and slit 69 into channel 88 and into the same aligned cut-out 47. This second end of line 18 extending around bundle 11 is labeled line 18A. This line relationship is also shown in FIG. 20.

In FIG. 12, disk mechanism 44 has been rotated clockwise by prawl 52 from the location shown in FIG. 11. This carried the two lines 18 and 18A clockwise and pulled the line tighter around the bundle. Extensions from locking mechanism 60 are forced between the individual disks 45 by this same rotation to force lines 18 and 18A between the two locking extensions and the three individual disks and grip the line ends securely.

In FIG. 12, both line ends 18 and 18A opposite mechanism 60 have been pulled taut and gripped by the rotation of capture disk 44. The next rotation of capture disk 44 will pull the next pair of lines extending into slit 69 taut and will carry the previous lines 18 and 18A, away from locking mechanism 60 to free the lines from the locking mechanism. The line advancement and operation by the capture disk is described in detail later.

Lower Apparatus, Clip Attachment

FIGS. 8, 10 and 20 show this operation. When needle 14 is positioned fully downward, line 18 is carried into slot 19 in table top 20, through slit 69 in bass 26, which opens up into channel 88 containing punch 26, and into the aligned cut-out 45. At this time line 18 has been wrapped around a bundle ready to be secured around the bundle by a clip.

Track 70 is shown in FIG. 8. A rail 72 is mounted perpendicular to track 70. A stack of clips 74 are inserted with their open end over the edge of rail 72 and held in place by track 70. Supports 76 connecting track 70 and rail 72 provide an unimpeded movement for clips 74 along the rail. Slide 78 has a slot along one side slidably engaging track 70. A tension reel 80 has a line 82 extending over a free wheeling guide wheel 84 thence back to slide 78, where a loop in the end of the line is secured over a cylindrical projection 86 attached to the side of clip slide 78. Real 80 exerts adequate tension on line 82 and subsequently on clip slide 78 to urge clips 74 rightward along rail 72.

Figure 11A:
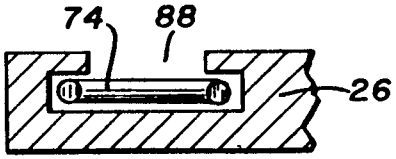
FIG. 11A is the view of A—A taken from FIG. 11.
Figures 13, 13A, 14:
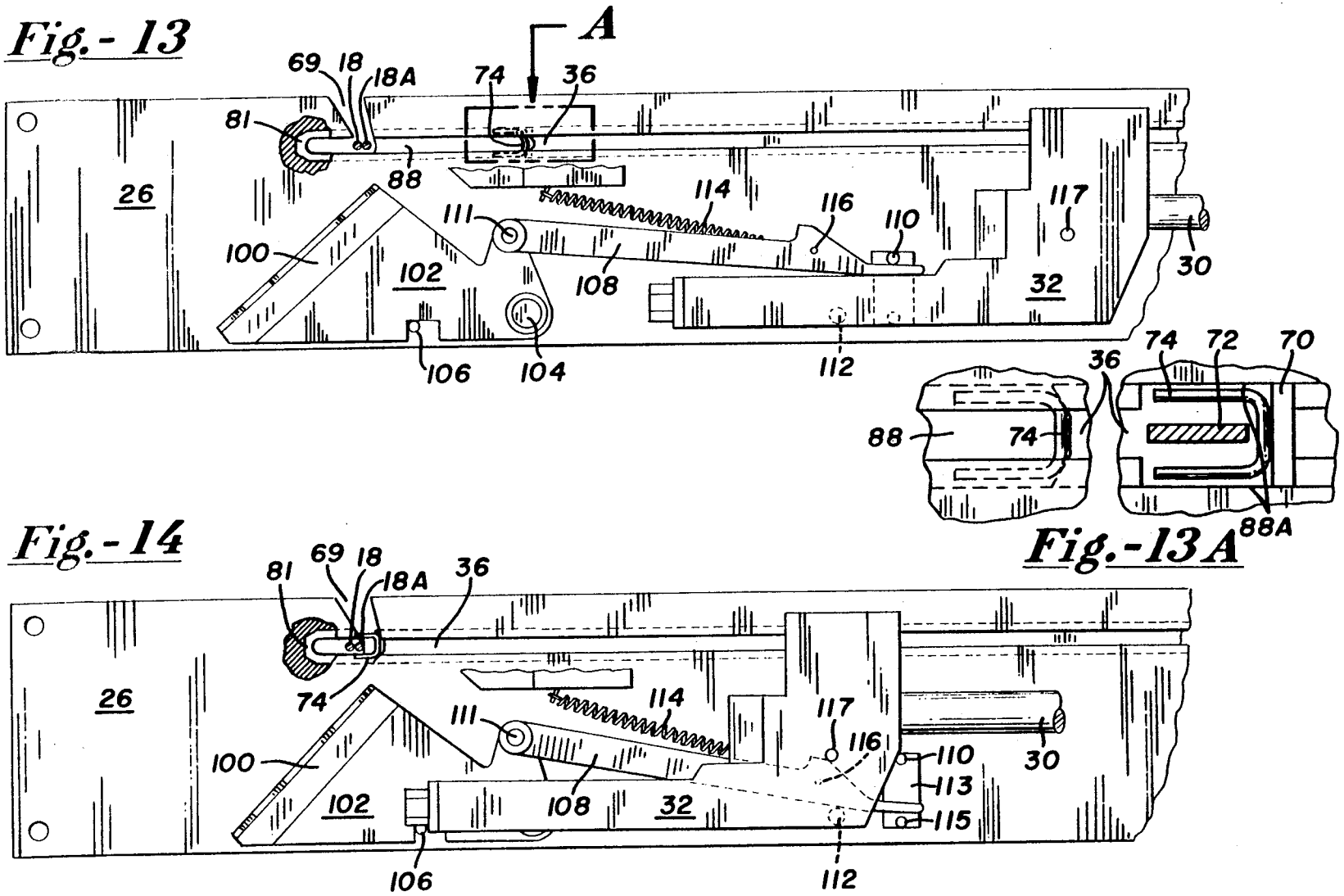
FIG. 13 is a plan view of lower apparatus with slide fully retracted and with capture disk omitted to show the cutting blade. The surface of the base is cut away to show the anvil mounting.
FIG. 13A is the portion of FIG. 13 which is blocked out and labeled A.
FIG. 14 is a the plan view of FIG. 13 with the slide partially extended. The surface of the base is cut away to show the anvil mounting.

Rail 72 curves inward to a perpendicular orientation to base 26 to end immediately above channel 88. This orients the end clip 74 horizontal to the base, aligned with channel 88, and open toward the lines. In FIGS. 11 and 12, channel 88 containing punch 36 can be seen. Channel 88 is dimensioned to slidably secure a horizontal clip 74, with the outer opening narrower than the clip to keep the clip within the channel, as shown in cross-section in FIGS. 11A and 13A. That portion of channel 88 directly opposite rail 72, designated 88A and shown in FIG. 13A, is made wider to permit loading a clip into the channel from the rail. Tension reel 80 exerts sufficient force upon the supply of clips 74 around rail 72 to force the end clip of the stack into channel 88 at channel portion 88A, where the clip is opposite punch 36. When end clip 74 is loaded into channel 88 this frees the clip from rail 72, since the rail ends immediately above the channel.

As shown in FIGS. 13 and 13A, the clip 74 of the stack of clips loaded into channel 88 is positioned adjacent to punch 36 with its open end facing lines 18 and 18A. The end of a punch 36 opposite the clip 74 is shaped to fit the adjacent rounded portion of the clip and engage the clip. As slide 32 is driven outward by rod 30, slide 32, attached to vertical slide member 34, which in turn is attached to punch 36, will carry the punch to the position shown in FIG. 14. Here clip 74 brackets both line ends 18 and 18A, which are the opposite ends of a length of the line wrapped around the bundle extending from capture disk 44.

Figure 15:
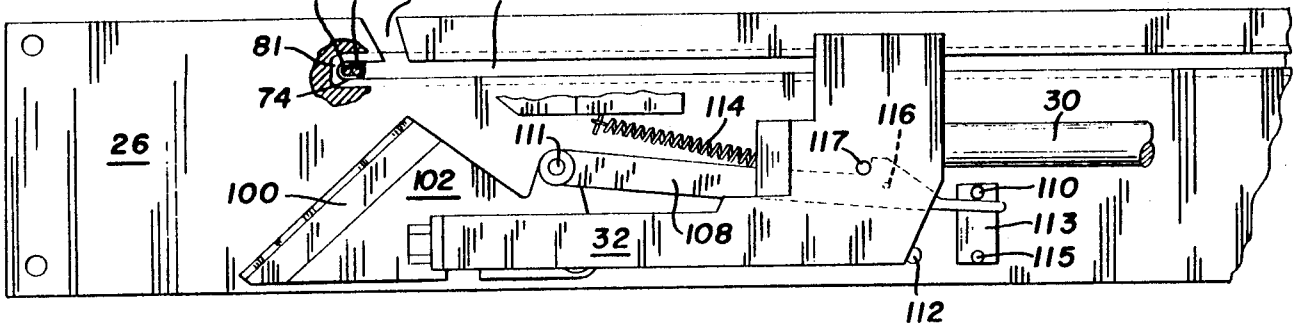
FIG. 15 is plan view of FIG. 13 with the slide fully extended. The surface of the base is cut away to show the anvil mounting.
Figure 17:
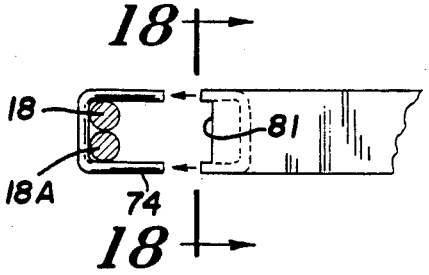
FIG. 17 is a side view detail of a clip and the end of the anvil.
Figure 18:
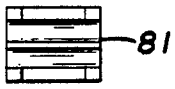
FIG. 18 is an end view of the anvil.
Figure 19:
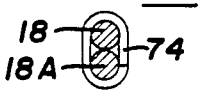
FIG. 19 show lines in cross-section secured by clip.

As punch 36 is driven completely outward, shown in FIG. 15, clip 74 is driven against an opposing anvil 81, the ends of the clip will be bent tightly around the line by the anvil. FIG. 17 shows a clip 74 oriented opposite anvil 81 around lines 18 and 18A. FIG. 18 shows grooves in the face of the anvil 81, arranged to turn the clip ends back about the lines and FIG. 19 when the clip points are forced against the anvil face. FIG. 19 shows the result of this process.

After line ends 18 and 18A have been secured tightly together by a clip 74 then slide 32 is returned to the position shown in FIG. 13. During this return of slide 32 lines 18 and 18A are cut to free the bundle as will be described next.

Lower Apparatus, Line Cutting Blade

After the ends of line 18 are gripped by capture disc 44 and locking mechanism 60 and the ends of the line clipped together, then the line is cut by the action of the line cutting mechanism using blade 100 and the blade operating mechanism, which is shown in FIGS. 8, 13, 14, 15, 16A and 16B. FIG. 8 shows the relationship of blade 100 to the remainder of lower apparatus 16, while FIGS. 13, 14, 15, and 16A emit some of the outer operating elements to show the blade action more clearly.

Blade 100 is operated by slide 32 on the beginning of the return cycle. The operating mechanism for blade 100 is engaged while slide 32 is moving outward from cylinder 28, as shown in FIGS. 13, 14, and 15. Blade 100 is attached to blade holder 102. Blade holder 102 is pivotally attached to base 26 with a pivot pin 104 secured in the base and extending through a mating hole in the blade holder. Stop pin 106 extending into base 26 is opposite a notch cut into blade holder 102 to prevent the blade holder from extending beyond the edge of the base. A blade actuator arm 108 is pivotally attached through a hole in the end of the arm to blade holder 102 by a mating pin 111 secured into the blade holder. Stop pin 110 and stop pin 112 restrict the excursion of the free end of blade actuator arm 108. One end of coil spring 114 is attached to a pin 116 which extends from the underside of blade actuator arm 108. The opposite end of coil spring 114 is secured to base 26. A nylon block 113 is attached to base 26 by stop pin 110 and pin 115. Actuator arm 108 rides upon block 113 which provides a low friction support for the arm. Pin 115 terminates at the surface of block 113 and does not interfere with the movement of arm 108.

A blade actuator pin 117 affixed through slide 32 extends inwardly and opposite blade actuator arm 108. In FIG. 13 slide 32 is shown completely retracted with spring 114 holding the free end of blade actuator arm 108 against stop 110, which also rotates blade holder 102 counter-clockwise against stop 106.

In FIG. 14, slide 32 is shown partly extended, which moves blade actuator pin 117 against the ramp shaped right edge of blade actuator arm 108, which in turn forces the free ramp shaped end of the actuator arm outward towards stop 112.

In FIG. 15, slide 32 is shown completely extended with slide pin 117 engaging actuator arm 108 at the recess in the arm immediately left of the ramp shaped end. This recess provides a purchase and connects slide 32 with blade actuator arm 108 on the slide return.

Figure 16A:
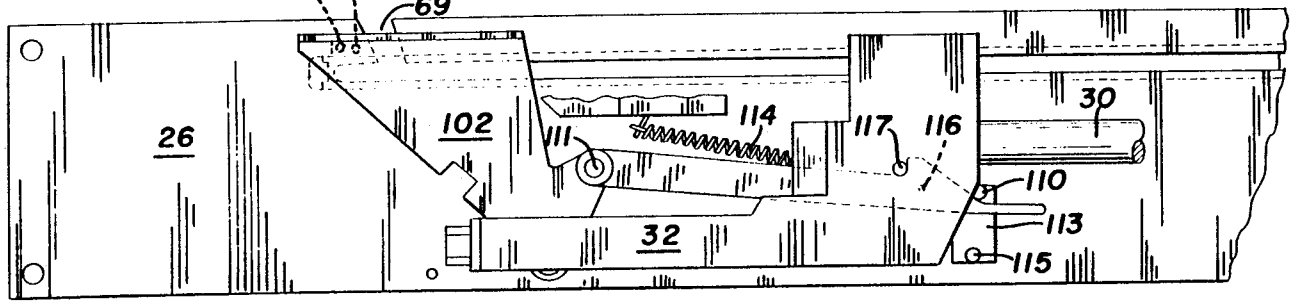
FIG. 16A is a view of 13 with slide partially withdrawn.
Figure 16B:
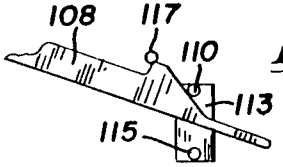
FIG. 16B is a detail of the blade actuating mechanism just before release.

Pin 117, as shown in FIG. 16A with slide 32 partially retracted, engages the recess in blade actuator arm 108 and has pulled the blade actuator arm inward along with it. This has rotated blade holder 102 clockwise and caused blade 100 to cut lines 18 and 18A. As slide 32 retracts further stop pin 110 will bear against the ramp shaped end of blade actuator arm 108 to move it outward clear of blade actuator pin 117. FIG. 16B shows blade actuator arm 108 just before its release from pin 117. After blade actuator arm 108 is freed from pin 117, spring 114 will return the arm, blade holder 102 and blade 100 to the position shown in FIG. 15 ready for the next cycle.

Line 18A which was gripped at the end of the previous cycle, also shown in FIG. 10, and line 18 which extends from needle 14, will both be severed which will result in a short line segment extending from the plane of the blade which is still gripped by capture disk 44. The opposite end of this short line segment will be released when disc member 44 is rotated another one-eighth rotation past locking mechanism 60. The location where the short line segment is released is where air is introduced to eject this line segment and any other line shards that may be present. This operation will be described later.

The other cut line end from the plane of the blade and gripped by the capture disk extends to needle 14 and becomes the end of the new line which is carried around the bundle by the needle on the next cycle.

Line Advancement by the Capture Disk

Figure 26:
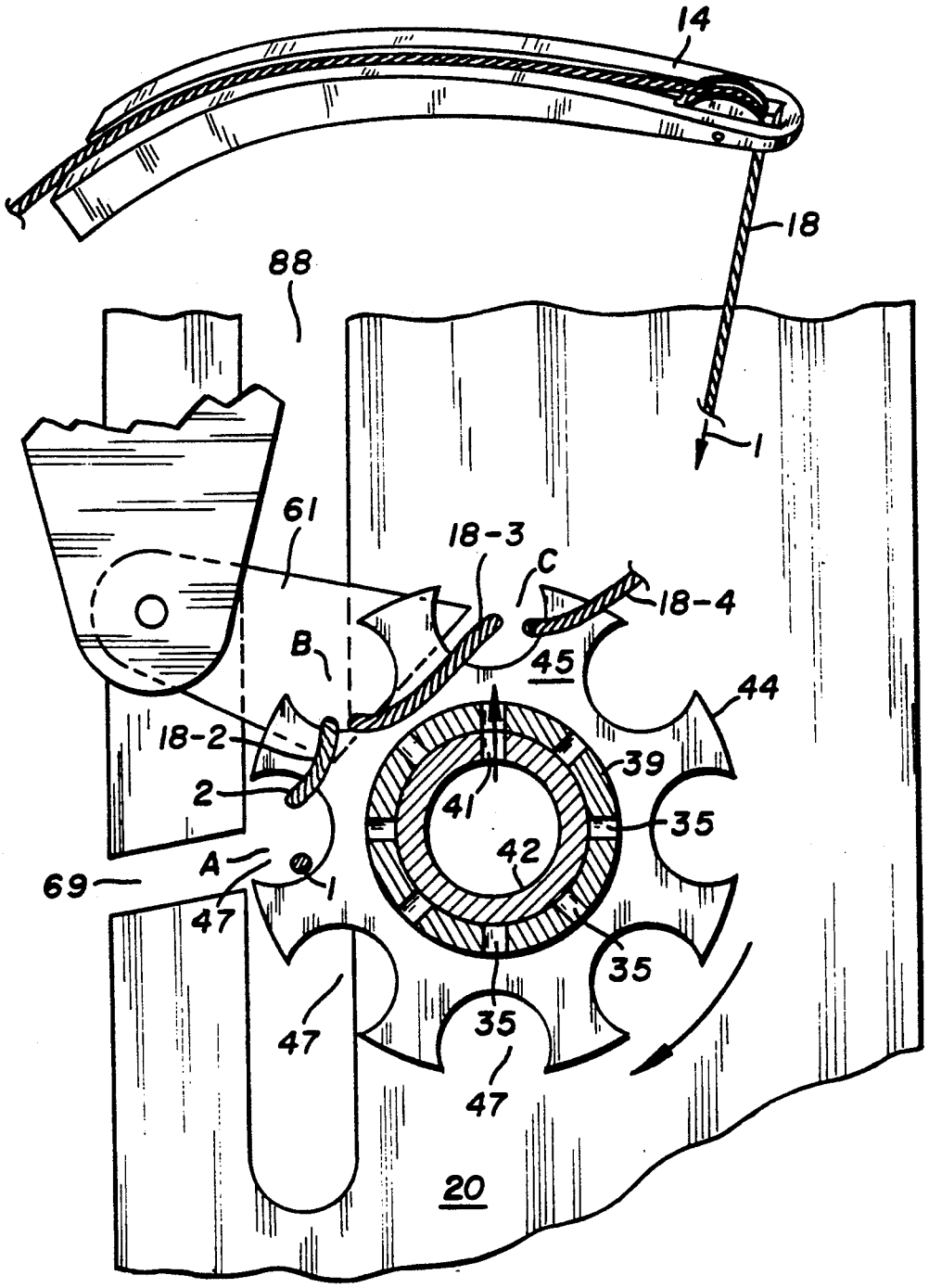
FIG. 26 is a top view of the capture disk showing parts which relate to the line segment advancement of successive cycles and to the ejection of short line segments.
Figure 26:
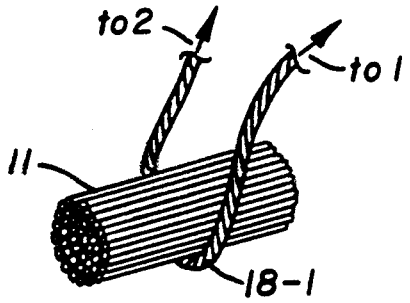

In FIG. 26 the advancement of line 18 through locations A, B, and C by successive rotations of capture disk 44 is shown by the locations of the various segments of line 18. These segments are designated as 18-1, 18-2, 18-3, and 18-4, and are generated in successive cycles of the apparatus. In the current cycle needle 14 has just pulled line 18 from the previous gripped end at position B, through cut-out 47 and slit 69 opposite location A, designated as point 2, and around bundle 11 with line end 1 extending to the needle at point 1 through the cut-out designated as point 1. This portion of line 18 wrapped around bundle 11 is designated 18-1. Line segments 18-2, 18-3, and the end of 18-4 extending through point 5 of capture disk 44, all terminate at the cutting plane of blade 100 because they were cut on previous cycles. This produces short line segments 18-2, 18-3 and 18-4 of the same length, since they were cut by blade 100 at base 26 in previous successive cycles. Line segment 18-1 extending around bundle 11 is an exception, since it has not yet been cut during the current cycle.

On each cycle a short segment of line will be cut which extends from the cutting plane of blade 100 through the cut-out 47 at location A back to location B where it is gripped by the capture disk 44 and the locking mechanism 60. Each successive operation will move the line ends, from position A where the line segment is wrapped around bundle 11, to position B which pulls the line segment tightly around the bundle and grips the two line ends, then to position C where the two line ends are moved away from locking extensions 61 and released.

Short Line Segment Removal

Air hose 43 and clamp 49 are shown in FIG. 10. One end of hollow axle 42 is shaped to fit within the slotted open end and mate with air hose 47. Clamp 49 is bolted to horizontal support member 40 to align hollow axle 42 in a specific orientation with respect to base 26.

Figure 22:
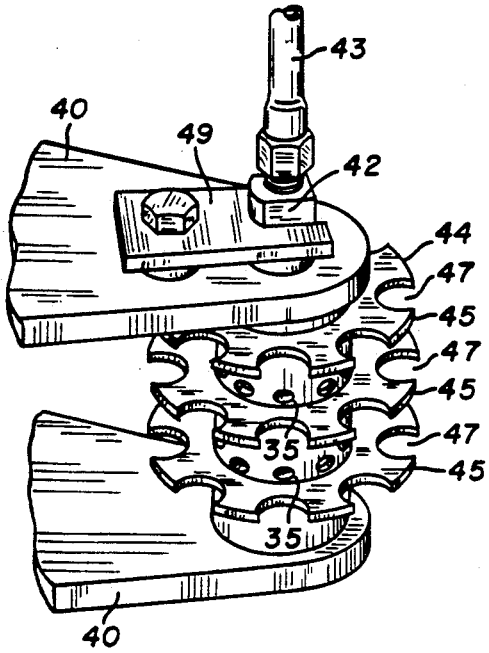
FIG. 22 is an isometric view of capture disk with the distance between adjacent disks exaggerated to show the holes into the hub.

Details of capture disk 44, its construction and short line segment removal elements are shown in FIGS. 20, 22, and 26. The illustration of FIG. 20 omits clamp 49 to show the connection more clearly. Hollow axle 42 is mounted within holes in horizontal support members 40 with the end opposite air hose 43 being closed. Individual disks are attached to hub 39 to form capture disk 44. Hub 39 is placed over hollow axle 42 and can pivot freely with respect to the axle. As shown in FIG. 26, hollow axle 42 has radial holes 41. There are two radial holes 41 which are located between individual disks 45 when capture disk 44 is pivotally supported by axle 42 and which are oriented toward position C where the second end of the short line segment is released as described earlier. Hub 39 has two sets of eight evenly spaced radial holes 35, one set of each being centered between adjacent individual disks 45 of capture disk 44, and with each radial hole of both sets centered within one of the disc cut-outs 47, one such set being shown in FIG. 26.

Air hose 47 receives air from the exhaust sides of cylinder 28, as described further in the pneumatic system description, whenever capture disk 44 is rotated. As described earlier, holes 41 are oriented to be opposite and centered with the disk cut-out 47 which has just released the second end of the short line segment at position C of FIG. 26, and which is also aligned with two radial holes 35 in hub 39, which are centered in that particular cut-out. Each time that cylinder 28 is moved air from the exhaust side of the cylinder will be forced through the two radial holes 41 in axle 42 and then through the two aligned radial holes 35 in hub 39. This exhaust air will eject the short line segment which has just been released, and prevent the released short line from jamming the mechanism. The other released line end is still gripped on the opposite end, which will be released and ejected on the next cycle.

Upper Apparatus, Dancer Arm

Support structure 120, shown in FIG. 1, provides support for dancer arm 22. Support structure 120 extends horizontally across table top 20 and is attached to tower 17 which in turn is attached to the rear side of table 12. Support structure 120 consists of a long bar parallel to the rear edge of table top 20 having shorter bars welded perpendicular to each end which extending forward horizontally. An inclined support bar 122, notched to fit at an angle, is welded to the rightmost shorter support bar. Support bar 122 has a hole through its upper end sized to accept a bolt 124. Dancer arm 22 consists of two parts welded together, a rod on the upper end welded to a shorter plate portion having a hole which mates with bolt 124 to provide a pivot. Bolt 124 is secured within the hole in inclined support bar 122 by a matching nut. Dancer arm 22 can rotate counter-clockwise to a generally horizontal attitude, where the plate end bears against the rightmost shorter support bars of support structure 120 which provides a stop. The plate portion of dancer arm 22 has a number of holes for adjustment located at different distances. A coil spring 126 is attached to dancer arm 22 by the end loop of the spring being placed into one of these adjustment holes. The end loop on the opposite end of coil spring 126 is attached to a chain 128 by securing the loop around the end link of the chain.

Figure 6:
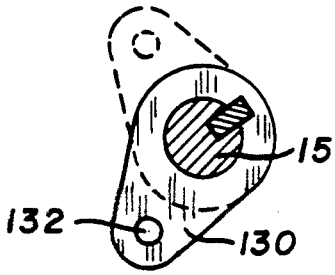
FIG. 6 is a cross-section of the axle with the driver plate in the clockwise position in solid outline and in the counter-clockwise position in dashed outline.

The opposite end of chain 128 is pivotally attached to a driver plate 130. As shown in FIG. 6, driver plate 130 is keyed to axle 15 and has an elongated extension on one side containing a hole 132. The end link of chain 128 is pivotally connected to hole 132 to attach the chain to driver plate 130.

Figure 4:
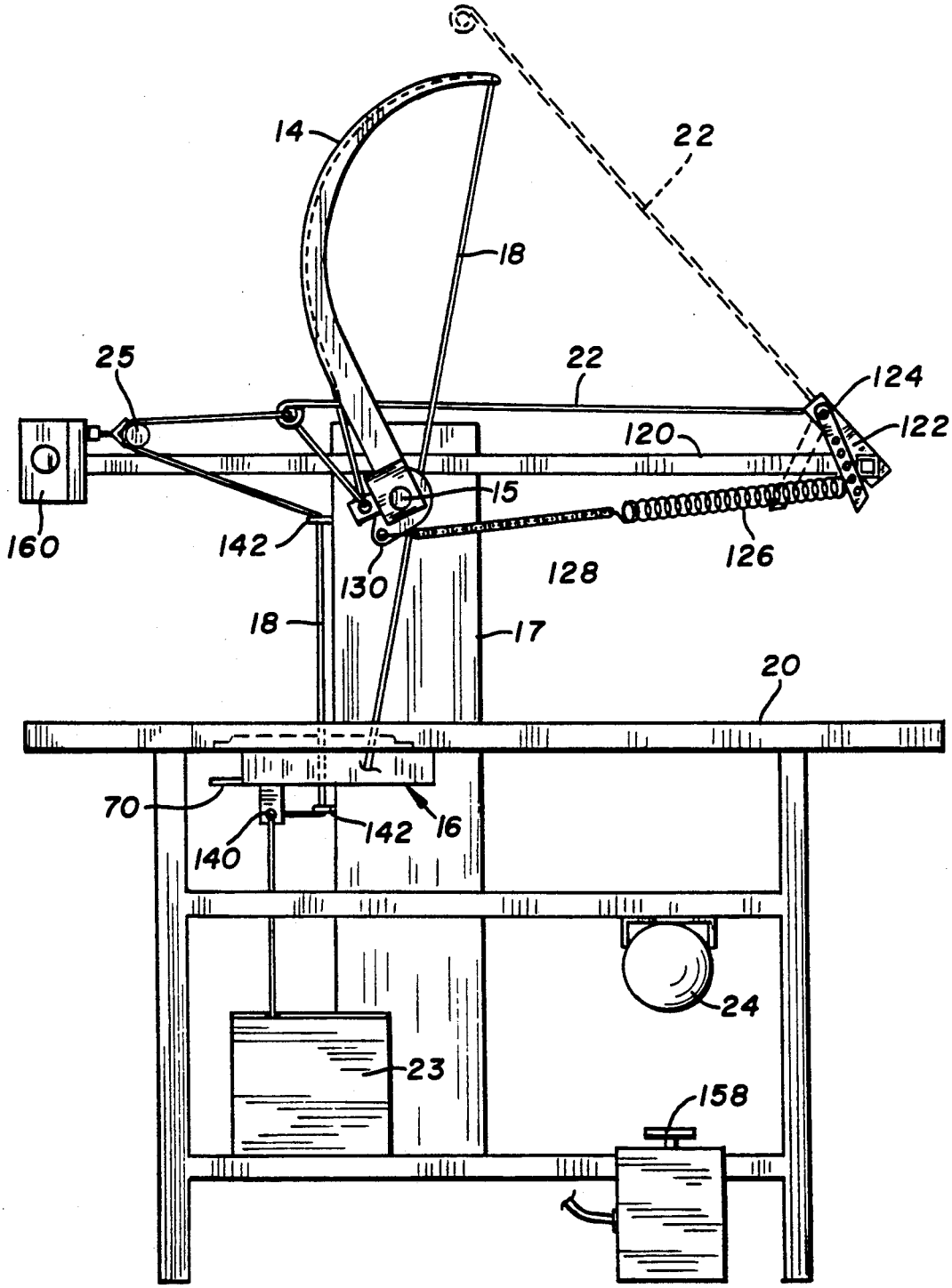
FIG. 4 is a front view of apparatus with one position of the dancer arm shown in solid outline and a second position of the dancer arm shown in dashed outline. Only the parts of the lower apparatus relating to the line are shown in detail.

As shown in FIG. 1, when needle 14 is rotated clockwise by axle 15, from the first position shown in solid outline to the second position shown in dashed outline, this rotation also causes driver plate 130 to pull on the end of chain 128. Chain 128 in turn pulls on spring 126 which pulls on the lower end of dancer arm 14, which moves the dancer arm from the position shown in solid outline to that shown in dashed outline, as shown in FIG. 4.

It can be seen that placing the end of spring 126 into an adjustment hole at various distances from pivot bolt 124 will change the lever arm length and change the amount of force exerted upon dancer arm 22 by driver plate 130. This action of axle 15 through driver plate 130, chain 128, and spring 126 upon dancer arm 22 is dynamic in that the rotation of the axle provides the force causing dancer arm 22 to rotate as the axle rotates.

When dancer arm 22 pulls upon line 18, the line must be held to generate tension in the line. Tensioner 25, interposed between line supply box 23 and dancer arm 22, is arranged such that the line is held until a force is applied which is greater than that established by an adjustment of the tensioner. This force is adjusted to always be greater than the amount of force which can be exerted by dancer arm 22 such that the movement of the dancer arm cannot pull any line free and reduce the tension.

Tensioner Operation

Figure 5:
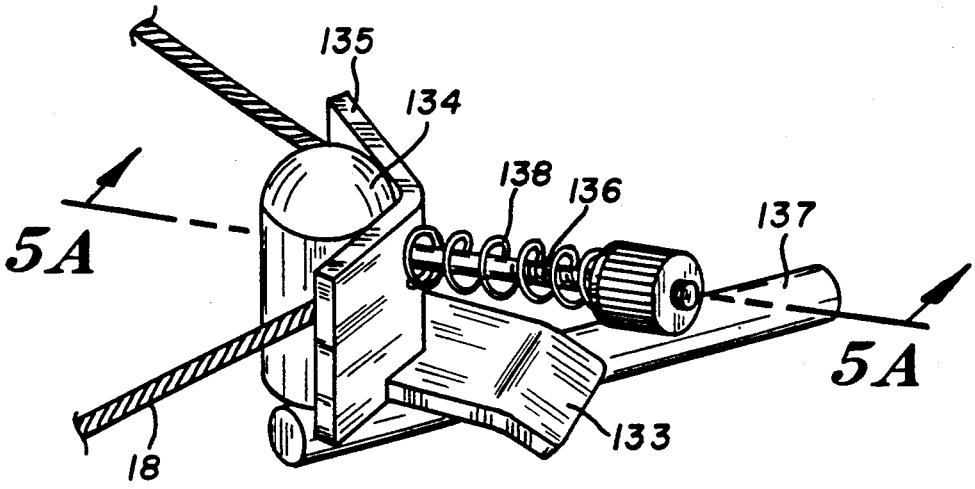
FIG. 5 is an isometric view of the tensioner.
Figure 5A:
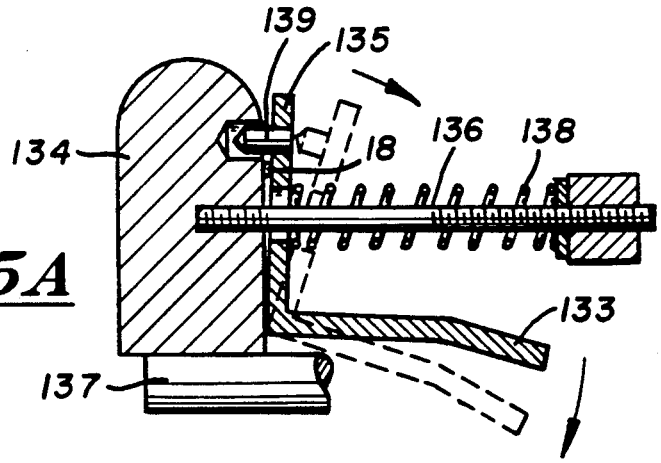
FIG. 5A is a cross-section view of the tensioner.

Tensioner 25 is shown in FIGS. 5 and 5A. These show a solid cylinder 134 and a bolt 136 sized and threaded into a mating threaded hole in the cylinder. Bolt 136 has an attached knurled knob for hand adjustment. A guide plate 135 adjacent to cylinder 134 has a central portion bent at approximately ninety degrees to partially enclose the cylinder. Spring 141 is mounted over bolt 136 to urge guide plate 135 against cylinder 134. Plate 133 is welded to guide plate 135 for additional strength. Bolt 136 extends through coil spring 138, through a mating hole in guide plate 135, and into the mating threaded hole in cylinder 134. Pin 139, attached to guide plate 135, fits into an opposed mating hole in cylinder 134.

Rod 137 is welded to one end of cylinder 134 and to support structure 120. Rod 137 is attached to support structure 120 such that the axis of cylinder 134 is generally perpendicular to the path of line 18. Tensioner 25 is positioned by bracket 137 such that the path of line 18 is around cylinder 134 and generally centered between bolt 136 and projecting pin 139. The depth of bolt 138 within the threaded hole in cylinder 134 determines the amount of force which spring 138 exerts upon guide plate 135. This force causes guide plate 135 to contact line 18 on or near two end points of the line between the guide plate and cylinder 134. The greater the force which spring 138 exerts against guide plate 135, the greater the force which will be required to pull line 18 around cylinder 134 between the cylinder and the guide plate. The amount of force which can be exerted by dancer arm 22 is determined by which adjustment hole receives the end of spring 126. The spring constant of spring 138 and the parts of tensioner 25 for the first embodiment are made such that the range of force with which tensioner 25 can grip line 18, by changing the position of bolt 136 within cylinder 134, will bracket the amount of force which dancer arm 22 can provide.

Needle Operation

Figure 7:
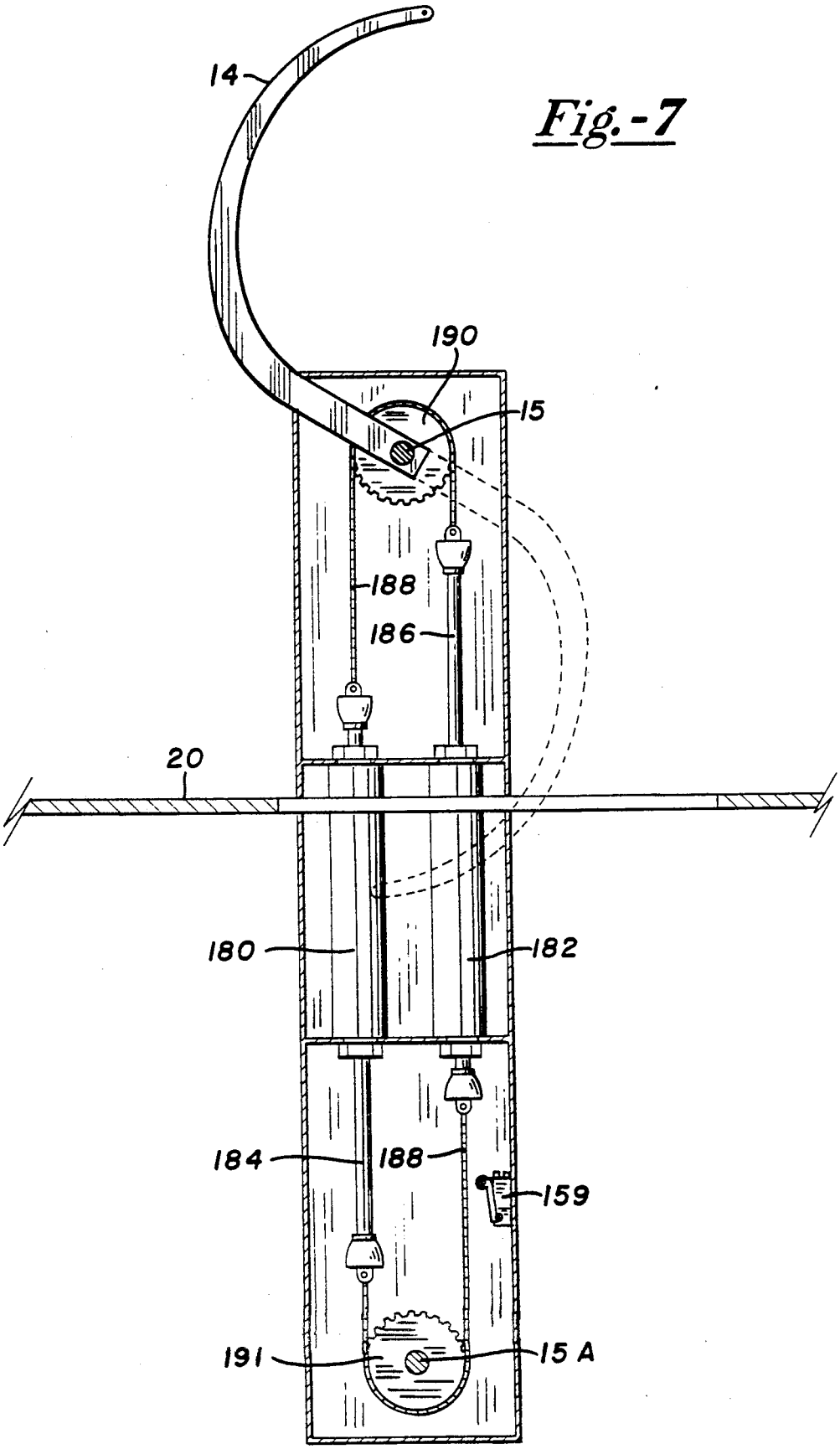
FIG. 7 is a front view of needle pneumatic driver mechanism with the needle in a fully counter-clockwise position shown in solid outline, and in a fully clockwise position shown in dashed outline.

In FIG. 7, tower 17 containing pneumatic cylinders 180 and 182 can be seen. Double extending double acting rod 184 extends from cylinder 180 and double extending double acting rod 186 extends from cylinder 182. Chains 188 connect adjacent ends of rods 184 and 186 together around gears 190 and 191. Cylinders 180 and 182 are cross-connected such that, when pressure is applied to the lower end of the piston connected to rod 186, pressure will be applied to the upper end of the piston connected to rod 184 and vice versa. This will result in the two rods 184 and 186 acting together to drive gears 190 and 191 and their respective axles 15 and 15A. Axle 15 has needle 14 attached on the end opposite gear 190.

Pneumatic switch 159 is closed by rod 186, when the rod is fully downward to signal to the pneumatic logic that needle 14 is fully clockwise.

Upper Apparatus, Bundle Wrapping Overview

As shown in FIG. 4, line 18 from supply box 23 is fed through hole 140 in lower apparatus 16, also shown in FIG. 8. In FIG. 4 only rail 72 and associated outer parts of the lower apparatus which guide line 16 are shown. From hole 140 line 18 is fed through guides 142 attached to tower 17, around tensioner 25, through a hole formed by a loop in the rod end of dancer arm 22, through a hole in a bracket mounted on the end of axle 15 next to needle 14, around and through the slot in the free end of the needle 14, and finally through slot 19 in table top 20.

Dancer arm 22 and its associated mechanism are arranged such that as the end of needle 14 moves downward toward slot 19, the dancer arm will maintain a continuous tension on line 18 as the dancer arm rotates from the initial position shown in solid outline to the final position shown in dashed outline. As described earlier, tensioner 25 provides a necessary grip which dancer arm 22 pulls against to achieve line tension.

The dancer arm assembly thus keeps a constant tension upon the line even though the clockwise rotation of the needle continually reduces the distance between the needle and the gripped line end. When needle 14 is returned to its initial counter-clockwise location by axle 15, dancer arm 22 will also be returned to its initial counter-clockwise location by the return of driver plate 130 to its initial position and the action of needle 14 pulling against the line. Since the end of the line is still being gripped, the rotation of needle 14 to its original counter-clockwise position will pull additional line from tensioner 25, since the needle can exert more force than dancer arm 22 and can overcome the tensioner adjustment. This force exerted against the line by needle 14 will also pull dancer arm 22 to its original generally horizontal counter-clockwise position ready for the next cycle.

The bundling sequence begins with the needle in the first counter-clockwise position, which positions the line from the gripped end extending upward through an aligned cut-out 47 in capture disk 44, through slit 69 in base 26 and through slot 19 in table top 26 to needle 14. Slide 78 is also fully retracted at this time. The operator then depresses foot switch 158 to initiate a complete bundling cycle. This causes needle 14 to rotate clockwise around the stock and insert the end of the needle through slot 19 in the table top, as shown in dashed outline in FIG. 1. This positions the two ends of the line about the bundle adjacent to each other as shown in FIG. 10. Essentially the end of line 16 which was gripped on the previous cycle has been carried through aligned cut-out 47, slit 69 and slot 19, wrapped around the nursery stock and carried back into slot 19, slit 69, and into aligned cut-out 47 by the action of needle 14. This is the also the situation shown in FIG. 26, where line segment 18-1 is wrapped around a bundle ready to be secured around the bundle by a clip.

After the needle has fully rotated to the second position with the needle fully clockwise, then slide 32 is extended to rotate capture disk 44 which tightens the line around the bundle. Punch 36 is carried outward by slide 32 to collect a clip 74 and, after the line is gripped, force the clip against anvil 81 to secure the clip around the line. After the clip is secured around the line, slide 32 will retract which will operate the blade mechanism to cut the line and free the bundle. After the line is cut the slide will retract and the needle will rotate from the second to the first position where the bundling operating cycle is complete. The operator then removes the bundle to clear the table for the next cycle.

Tension Assist Mechanism

Figure 24:
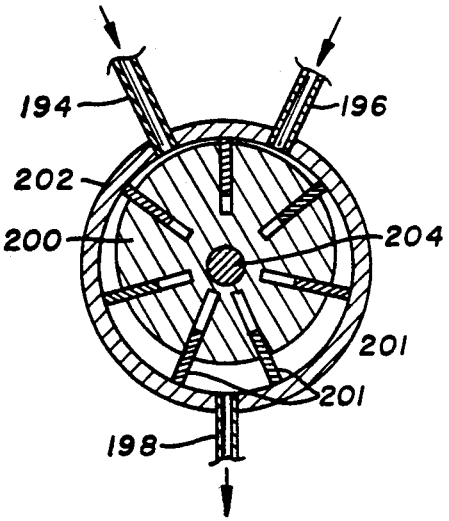
FIG. 24 is a cross-section taken along 24—24 in FIG. 23.

A second embodiment adds a tension assist mechanism using air motor 192, shown in cross-section in FIG. 24. Intake ports 194 and 196 are connected to a control valve while exhaust port 198 exhausts to the atmosphere. Rotor 200 is offset from the center of case 202. Rotor 200 has vanes 201 which retract into axle 202, such that they extend completely to case 202 regardless of which portion of the case they oppose. The vanes are retracted further into rotor 200 at the top than at the bottom. With this arrangement air under pressure introduced into port 196 will cause rotor 200 to rotate clockwise, and air under pressure introduced into port 194 will cause the rotor to rotate counter-clockwise.

Figure 23:
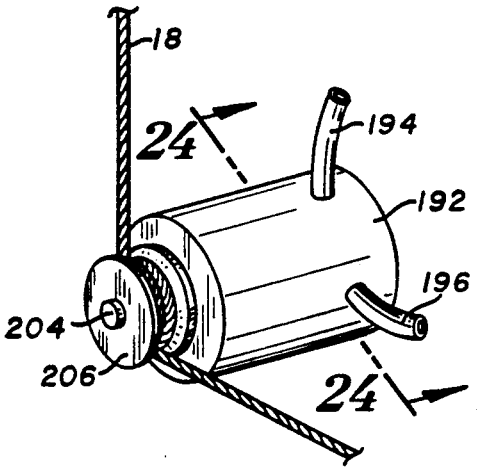
FIG. 23 is an isometric view of the air motor and line.
Figure 25:
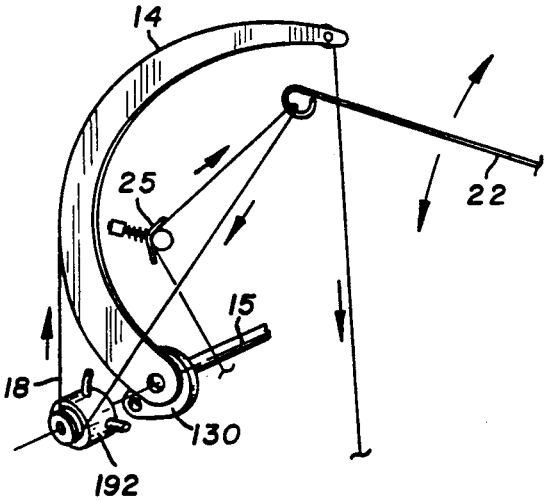
FIG. 25 is a schematic view of the line showing the threading of the line through the air motor and related elements.

Shaft 204 from rotor 200 is shown attached to drum 206, as shown in FIG. 23. Air motor 192 is shown in FIG. 25, mounted next to needle 14 on the end of axle 15. One end of line 18 from needle 14 is wrapped around drum 206 with the opposite end extending through the loop in the end of dancer arm 22 to tensioner 25. Ports 194 and 196 attach to hoses, not shown, which extend along axle 15 thence to a control valve.

Figure 21:
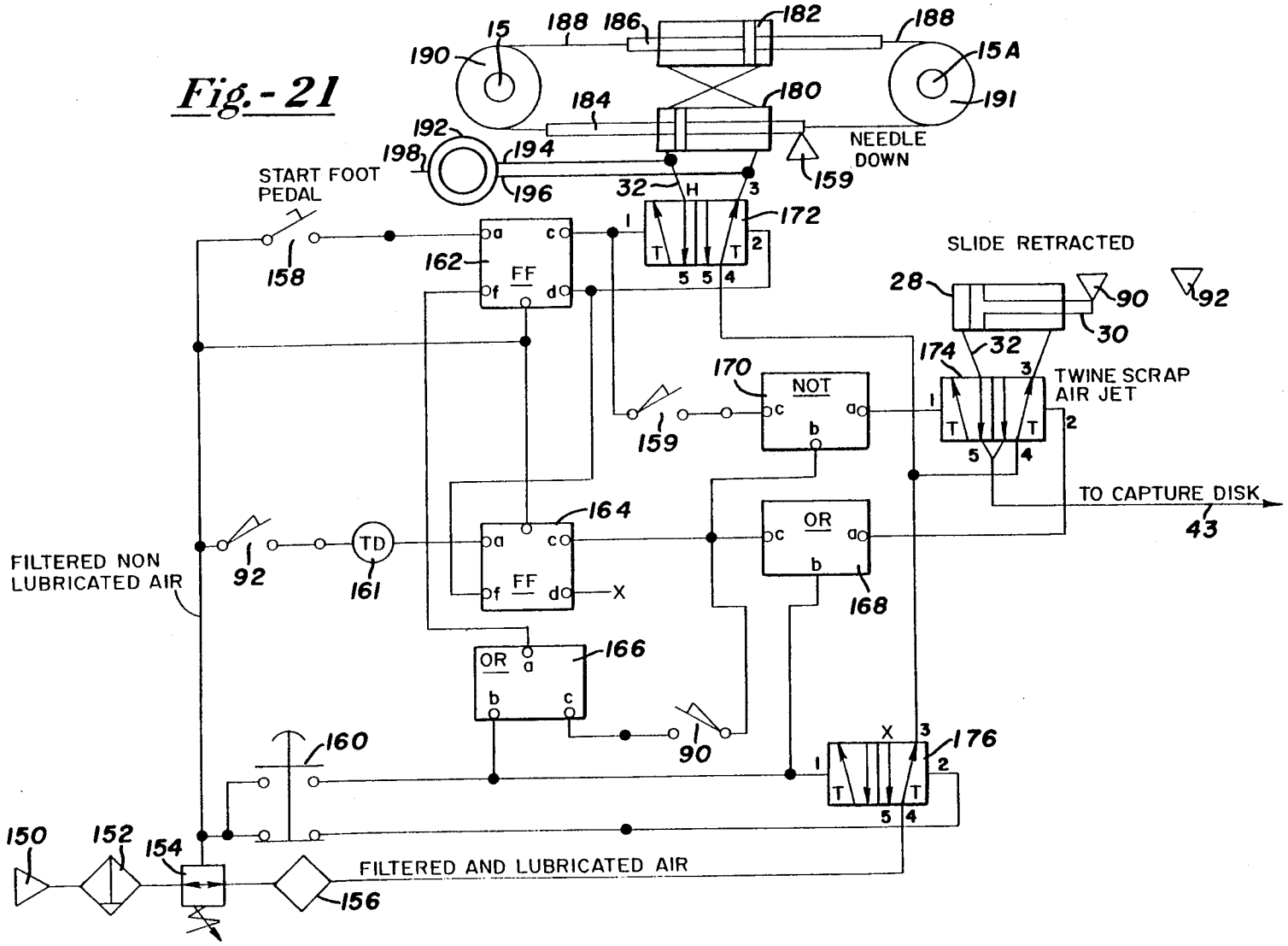
FIG. 21 is a schematic of the pneumatic control system.

The connections to the control valve from air motor 192 are shown in FIG. 21. They are arranged such that when needle 14 moves downward clockwise drum 206 will rotate to increase the tension in line 18 as an assist to dancer arm 22. When needle 14 moves upward drum 206 will reverse the direction of rotation and reduce the tension on dancer arm 22. This use of drum 206 results in a tighter bundle than with dancer arm 22 alone.

Pneumatic Logic

The position of slide 32 relative to base 26 is sensed by the use of two pneumatic switches 90 and 92, shown in FIG. 8, which are used to control the excursion of the slide. Slide 32 has ramps 94 and 96 located on opposite ends. Rollers mounted on pneumatic switches 90 and 92, which are attached to an arm, ride upon the top of slide 32 for one position and extend beyond the slide for a second position when their respective roller has cleared the ramp. A projection from the bottom center of each pneumatic switch is depressed when its arm is raised by the roller riding up a ramp incline to open switch switches 90 and 92.

A schematic representation of the pneumatic system using pneumatic logic is shown in FIG. 21. Here pneumatic switch 92 provides information when slide 32 is extended outward, and switch 90 provides information when the slide is inward.

As shown in FIG. 7, pneumatic switch 159 is closed by the extension of rod 186 when needle 14 is rotated fully clockwise. Storage tank 24 is connected to the system at point 150 where the air passes through a filter 152. This filtered air is then regulated to approximately 80 pounds per square inch gage by regulator 154. This regulated air is connected to a lubricator 156 which inserts lubricating oil into the air.

The regulated non-lubricated air is connected to pneumatic start switch 158, which is foot operated, and is shown physically in FIG. 1 mounted near storage tank 24. This is used to initiate the operation of a bundling cycle. This air is also connected to pneumatic switch 92. Slide 32 closes switch 92 when fully extended, and closes switch 90 when fully retracted.

The regulated air is connected to stop/reset switch 160, also shown physically in FIGS. 1 and 4 mounted on support structure 120. When switch 160 is pulled outward the operation of the system is stopped and when pushed inward the system is reset. As described earlier, pneumatic switch 159 is closed when needle 14 is fully rotated clockwise to a downward position.

Pneumatic switch 92 is connected to time-delay chamber 161 through a small orifice which restricts the air flow such that one to two seconds is required to reach a pressure adequate to set flip-flop 164. This delays the retraction of needle 14 until after the extension of slide 32.

Flip-flops 162 and 164 have a set input port at a, a reset port at f, having an output at c when set and at d when reset. OR logic elements 166 and 168 provide an output at port a when there is an input at either one of the input ports b or c. NOT logic element 170 provides output at port a whenever there is no input at either ports b or c.

Control valves 172, 174, and 176 have input control ports 1 and 2, output ports 3 and 3*a*, 4, source ports 4, and exhaust ports 5. When pressure is provided to source port 5 and control port 1 is pressurized the source will be switched to output port 3A, and if instead there is pressure on control port 2 the source will be switched to output port 3.

Stop/reset switch 160 must be pulled out for the system to operate. This disconnects air pressure from port b of OR logic 168 and connects the pressure line to port 2 of control valve 176. This will switch the air connected from lubricator 156 to source port 4 of control valve 176 to output port 3, which is connected to source ports 4 of control valves 172 and 174 as an air source for these valves and provide power for the needle and slide operations.

When start switch 158 is closed to initiate a bundling cycle by pressing the foot pedal, then filtered non-lubricated air from regulator 154 is connected to input port a of flip-flop 162, to set the flip-flop and provide an output on port c. Port c is connected to stop switch 159 which is open at this time. Port c is also connected to line 1 of control valve 172 which switches the source of line 4 to output line 3A.

Output line 3A is connected to the left end of cylinder 180 which is cross-connected to the right end of cylinder 182. This acts upon double acting pistons within the cylinders to cause rod 184 to move rightward and rod 186 to move leftward which have their adjacent ends connected together by chains 188. Chains 188 are partially wrapped around gears 190 which in turn causes axles 15 and 15A to rotate counter-clockwise. This view of the axles 15 and 15A correspond to a clockwise rotation of needle 14 downward as viewed from the operator's position in front of the machine.

When needle 14 has rotated fully extending through slot 19 it will contact stop switch 159 causing it to close and provide air to port c of NOT logic 170, and since at this time there is no air is supplied to port b, because switch 90 is open, air is supplied f rom port a to port 1 of control valve 174, which causes the control valve to switch source 4 to output line 3A connected to the left end of the cylinder 28.

This air on the left end of cylinder 28 will move piston rod 30 outward. When rod 30 is fully extended switch 92 will close as described earlier. The closure of switch 92 will connect air to time delay chamber 161 which will slowly fill and when adequate pressure is present, after one or two seconds, will act upon input port a of flip-flop 164 to set it. Flip-flow 164 when set will output air from port c to port b of NOT logic 170, to pneumatic switch 90 and to port c of OR logic 168.

With air pressure both on port c and on port b of NOT logic 170, the output at its output port a will shut off, and with air pressure on port c of OR logic 168 pressure will be present at its output port a. This output from port a of OR logic 168 will switch source 4 of control valve 174 from line 3A to output line 3 on the right end of cylinder 28 which retract rod 30. As soon as rod 30 has withdrawn from stop switch 92, the switch will open.

When rod 30 carrying slide 32 is fully retracted this will close switch 90. This closure will supply air pressure to port c of OR logic 166 which will cause an output from output port a, which is connected to port f of flip-flop 162 and reset the flip-flop.

Reset flip-flop 162 has pressure on output port d and no pressure on port c. Port d of flip-flop 162 is connected to input port 2 of control valve 172 and to control port f of flip-flop 164. This will switch source 4 of control valve 172 to port 3 and retract needle 14 which opens switch 159. This also resets flip-flop 164 which to switch the output from port c to port d. This in turn will turn off OR logic 168 and NOT logic 170 to restore the system to the conditions for the beginning of a new cycle.

If stop/reset switch 160 is pushed at any time during the operating cycle, control valve 176 will switch source port 4 away from line 3 to cut off power to the sources of control valves 172 and 174 and stop the pistons immediately.

Air motor 192 is connected to the two outputs of control valve 172 such that it is driven along with needle 14. This arrangement assures that the direction of rotation and timing of rotation of air motor 192 is consistent and concurrent with needle 14. These connections are made such that the motor will assist in applying tension to line 18 as needle 14 is rotated clockwise downward and will reverse when the needle direction is reversed.

Overview

This apparatus solves a number of problems present in existing equipment. The use of a metal clip rather than tying the lines provides a much stronger line connection means with none of the complications and unreliability of equipment used to tie knots in line. The use of supplemental equipment to place tension upon the line as the line is wrapped results in a more compact bundle. Following this process with additional force applied to the lines wrapped about the bundle further compacts the bundle beyond previous results. The use of a gripper which interlaces the line between a number of sharp edges results in a very strong grip which also assists in providing a compact bundle. The use of a single pneumatic cylinder and a single compact apparatus to provide all of the functions of tightening, gripping, clipping and cutting the line assures proper synchronization as well as a compact reliable machine. The use of pneumatic power to both power the machine and the logic results in a free standing machine which can be charged in a shop and used in the field with no outside power sources being required and no possibility of electrical shock. The use of pneumatic control logic essentially identical to electronic control logic permits the use of sophisticated control logic in this apparatus with no reliability problems.

While this invention has been described with reference to an illustrative embodiment, this description is not intended to be construed in a limiting sense. Various modifications of the illustrative embodiment, as well as other embodiments of the invention, will be apparent to persons skilled in the art upon reference to this description. It is therefore contemplated that the appended claims will cover any such modifications or embodiments as fall within the true scope of the invention.

What is claimed is:

1. In an apparatus for wrapping nursery stock of the type in which a line is carried from a source in a predetermined path from a highest position downward and around said nursery stock to a lowest position with an oscillating arcuate needle, the improvement comprising:

(a) tensioner means for holding the line between the source and the needle with a predetermined force; said tensioner means having adjusting means for adjusting said predetermined force; and (b) dancer arm means for providing line tension by pulling the line away from a is direct path between the tensioner means and the needle against the predetermined holding force as the needle wraps the line around the nursery stock; said dancer arm means having adjusting means for adjusting the line tension.

2. Apparatus as in claim 1 wherein said tensioner means comprises:

(a) a cylinder having support means attached to the apparatus for holding said cylinder in the path of the line between the source and the dancer arm means with the cylinder oriented such that the line will at least partially encircle and bear against a portion of said cylinder; and (b) a guide plate sized, bent, and having mounting means for attached said guide plate to said cylinder such that said guide plate will contact said cylinder on at least one point of the line encirclement; and (c) spring means for forcing the guide plate against the cylinder against a point of line contact.

3. Apparatus as in claim 1 wherein said dancer arm means comprises:

a) a rod having a driven pivoted end and a free end, the free end having an opening for receiving the line, with the rod being pivoted around its driven end in a plane parallel to the line path, but with the driven end of the rod being offset horizontally from the needle, in the same horizontal direction as the needle moves from the highest to the lowest position such that the rod cannot interfere with the needle movement; and b) driving means for rotating the rod about the pivoted end being arranged such that the free end of the rod extends essentially horizontally towards the needle at a first position and moves a proportional amount between the first position and a higher second position as the needle moves between the highest position and the lowest position.

4. Apparatus as in claim 3 wherein said driving means comprises:

a) a horizontally oriented oscillating axle with the needle being attached thereto such that the needle will be oscillated thereby in a plane perpendicular to the axle; and b) a driver plate mounted upon the oscillating axle in a plane perpendicular to the axle, the plate being offset with respect to the axle, and keyed to the axle at a predetermined angle from the needle; and c) a plate extension attached to the driven end of the rod being oriented such as to lie in the plane of rotation of the rod at a predetermined angle with respect to the rod, the plate extension having a plurality of adjustment holes with each hole being spaced a different distance from the axle; and d) a coil spring having a first and a second end with the first end being attached to the offset portion of the driver plate, and with the second end of the coil spring being attached to an adjustment hole in the plate extension, the driver plate dimension, the angle of the driver plate offset with respect to the needle, the length of the plate extension, and the angle of the plate extension with respect to the rod being such that, as the needle moves from the highest to the lowest position, the spring will pull against the plate extension and rotate the free end of the rod from the first to the second position.

5. Apparatus as in claim 1 and further comprising tension assist means for increasing the line tension on the line between the dancer arm means and the needle by pulling on the line between the needle and the dancer arm means.

6. Apparatus as in claim 5 wherein the tension assist means further comprises:

a) a motor having a shaft and a drum, with the drum being mounted centered upon the shaft and driven thereby, and b) a horizontally oriented oscillating axle, the axle having a supported driven end and an unsupported free end, and the arcuate needle having a driven end and an opposite free end, the driven end of the needle being attached to the axle such that the needle will oscillate in a plane perpendicular to the axle with the arcuate shape in the plane of oscillation, with the concave side of the needle leading as the needle is oscillated from the highest to the lowest position, with the free end of the needle having a hole therethrough sized to receive the line; and with the motor being mounted on the free end of the oscillating axle with the motor shaft aligned therewith; and c) the line from the source first encircling the tensioner means cylinder, thence to the dancer arm means, then being wrapped around the drum, then extending from the drum along the convex side of said needle, through the hole in the free end of the needle, and thence to the nursery stock, the motor being rotated in the direction which will increase the tension on the line during the oscillation of the needle from the highest to the lowest position.

7. In an apparatus for carrying a line from a source in a predetermined path from an upper position downward and around nursery stock to a lower position of the type using an oscillating arcuate needle, the improvement comprising:

a) a horizontal oscillating axle having a driven end and a free end with the needle having a driven end which is attached to the oscillating axle such as to be oscillated thereby in a plane perpendicular to the axle; and b) a support structure for said apparatus having a table with a horizontal table top, the table top having a slot extending therethrough; the slot and oscillating axle being arranged such that the plane of the arcuate needle motion is perpendicular to the plane of the table top and aligned with the slot, and such that the needle will extend into the slot at the lowest needle position and carry the line therethrough; and c) lower apparatus mounted under said table top adjacent to said slot comprising:

i) a generally cylindrical shaped capture disk having opposed planar surfaces and at least five equally spaced identical cut-outs disposed around the periphery thereof, the cut-outs being shaped and arranged to bracket and engage any lines extending perpendicularly therethrough, the capture disk being pivotally mounted on its center upon the lower apparatus such that lines extending through the slot will extend perpendicularly through a cut-out at a first location with respect to the lower apparatus; and ii) prawl means for rotating said capture disk in a first direction through a predetermined angle during each cycle of operation by engaging and extending against a cut-out, the predetermined angle being equal to the angle between adjacent cut-outs; the capture disk and prawl means being arranged such that bracketed lines extending through a cut-out at the first location will be engaged and carried in the first direction through the predetermined angle to a second location during a cycle of operation, lines which were carried from the first to the second location on the previous cycle will be carried in the first direction through the predetermined angle from the second to a third location during a cycle of operation, lines which were carried from the second to the third location on the previous cycle will be carried in the first direction through the predetermined angle from the third to a fourth location, and a cut-out will be carried in the first direction through the predetermined angle to the first location; with the prawl means engaging a cut-out at a location other than the first, second, third and fourth position.

8. Apparatus as in 7 wherein said lower apparatus further comprises:

(a) rotation locking means for securing the capture disk at the end of each cycle of rotation; and (b) gripping means for gripping lines arranged such that lines at the second location are first forced against the capture disk to be gripped and the lines then tightened as the cutout completes the rotation from the second to the third position;

(c) blade means for cutting lines gripped at the third location arranged such that lines are cut between the capture disk and the table top after the rotation of the capture disk which carried the lines from the second to the third location.

9. Apparatus as in claim 8 wherein said cylindrical shaped capture disk has at least one recess of a uniform depth extending completely around the periphery thereof equidistant from one of the planar disk surfaces, the gripping means having extensions of a quantity, size, shape, and orientation such that they will extend within and between each recess in the capture disk as the disk rotates from the second to the third location and force lines into each respective opposed recess in the disk to be gripped therebetween, with the extensions having means for changing the amount which the extensions extend within the recesses in the capture disk to change the gripping force.

10. Apparatus as in claim 9 wherein the cylindrical shaped capture disk is comprised of at least one pair of planar individual disks and a connecting hub, with each individual disk having a centered hole the size of the hub, the individual disks being attached to the hub with the centers aligned, with the surfaces parallel with each other and perpendicular to the hub, and spaced a predetermined distance from each another, such that the space between the disks provides the recess for the gripping means extensions, and with the cut-outs of each individual disk being aligned with each other.

11. Apparatus as in 10 and further comprising pneumatic means for expelling line segments cut from the end of the line at the third location outward from the capture disk cut-outs at the fourth location during each cycle of operation of said rotation means.

12. Apparatus as in claim 11 wherein the pneumatic expelling means comprises:

a) the hub being hollow and having a set of holes centered upon each cut-out, and between each adjoining pair of individual disks; and b) a hollow axle having a blocked end and an open end extending through the hub being sized and arranged such as to pivotally support the capture disk, the hollow axle having a hole between each adjacent pair of individual disks, with the axle being attached to the lower apparatus such that the holes in the axle are centered upon the fourth position of the cut-outs and also centered between each set of adjacent individual disks; and c) pneumatic means for providing a source of pressurized air to the open end of the hollow axle during each rotation cycle, the holes in the axle and the holes in the hub being sized, aligned and arranged and the pressurized air introduced such that pressurized air will be forced through the holes in the axle outward through holes in the hub at the fourth position during each rotation cycle.

13. Apparatus as in claim 8 wherein the rotation locking means comprises a flat spring which is sized, oriented and arranged to tangentially engage a cut-out at the end of each rotation cycle, other than a cut-out which is located at the first, second, third and fourth position, the flat spring being oriented such as to permit the capture disk to rotate in the first direction but to block the opposite direction of rotation.

14. In an apparatus for carrying a line from a source in a predetermined path from an upper position downward and around nursery stock to a lower position of the type using an oscillating arcuate needle, the improvement comprising:

a) a horizontal oscillating axle having a driven end and a free end with the needle having a driven end attached to the axle such that the needle is oscillated thereby in a plane perpendicular to the axle; and b) oscillating axle pneumatic drive means for driving the oscillating axle; and c) a support structure for said apparatus having a table with a horizontal table top, the table top having a slot extending therethrough; the slot and oscillating axle being arranged and located such that the plane of the arcuate needle motion is perpendicular to the table top and aligned with said slot, and such that the needle will extend into said slot at the lowest needle position to carry the line therethrough; and d) lower apparatus mounted under said table top adjacent to said slot comprising:

i. clip attachment means for affixing a U-shaped metal clip around lines extending through the slot; and ii. line cutting means for cutting lines extending through said slot between the table top and the lower apparatus; and iii. slide means arranged to translate parallel to said table top between a first and a second position for operating said clip attachment means, and slide pneumatic drive means for translating said slide means, said slide means being arranged such that, as the slide means moves under said table top from the first to the second position the slide means will engage the clip attachment means which will affix a U-shaped metal clip around lines extending through the slot, and such that as said slide means moves from the second to the first position, the slide means will engage the line cutting means which will cut lines extending through said slot; and e) pneumatic logic means for controlling the slide pneumatic drive means and for controlling the oscillating axle pneumatic drive means, said pneumatic logic means having pneumatic switch initiating means for initiating an operating cycle, having emergency stop means for stopping the operating cycle at any part of the cycle, and having time delay means with a predetermined delay for delaying the slide pneumatic drive means a predetermined time with respect to the oscillating axle pneumatic drive means; the pneumatic logic means being arranged such that an operating cycle will always begin with the oscillating needle in the upper position and the slide in the first position, the needle will then move from the upper to the lower position, and after the predetermined time delay the slide will move from the first to the second position, after which the needle will return to the upper position and the slide will return to the first position to complete the cycle where they will remain until another cycle is initiated.

15. Apparatus as in claim 14 and further comprising:

(a) tensioner means for holding the line between the source and the needle with a predetermined force; and (b) dancer arm means for providing line tension by pulling the line away from a direct path between the tensioner means and the needle against the predetermined force as the needle wraps the line around nursery stock, and (c) tension assist means for increasing the line tension on the line between the dancer arm and the needle by pulling on the line in a location between the needle and the dancer arm, and (d) pneumatic means for operating the tension assist means; and (e) said pneumatic logic control means also operating said pneumatic means for operating the tension assist means such that as the needle moves from the upper to the lower position the tension assist means will increase the line tension.

16. Apparatus as in claim 15 and further comprising pneumatic means for clearing cut ends of the line from the lower apparatus using air from the pneumatic means which powers the slide means from the second to the first position.

17. In an apparatus for carrying a line from a source in a predetermined path from a highest position downward and around nursery stock to a lowest position of the type using an oscillating arcuate needle, the improvement comprising:

(a) a table having a horizontal table top with a slot therethrough, the slot and needle being arranged such that at the lowest position of the needle, said needle will extend into said slot and carry the line therethrough; and (b) lower apparatus mounted under said table top and adjacent to said slot having clip attachment means for affixing a U-shaped metal clip around any line extending through the slot and having blade cutting means for cutting lines extending through said slot between the table top and the lower apparatus;

(c) said clip attachment means further comprising a channel parallel to said table top disposed such as to intersect lines extending through the table top slot to the needle in the lowest position, the channel being sized and arranged to slideably engage a U-shaped clip, having an open end and a closed end, such that the open end of the clip is directed toward the lines, the clip is oriented parallel to the table top and the open and closed ends of the clip extend across the channel; and having a punch slideably positioned within the channel with a shaped end extending across the channel which is shaped to mate with and engage the closed end of a clip slideably positioned within the channel, said punch having translation means for translating said punch between a first position and a second position within said channel; and having clip transport means adjacent to said channel for slideably enclosing a stack of clips such that the open ends and the closed ends of adjacent clips are aligned with each other, and for transporting the end clip of said stack of clips which is adjacent to said channel into said channel, when the punch is located at the first position within the channel, such that the clip ends extending across the channel, and the channel slideably engages the clip with the closed end of the clip adjacent to the punch and with the open end of the clip directed away from the punch, and having anvil means for bending the open ends of a clip, said anvil means being positioned within said channel adjacent to the second position of said punch, the anvil means having a face of a predetermined shape directed towards said punch, the punch, channel and anvil means being arranged such that as the punch moves within the channel from the first to the second position, a clip placed within the channel by the clip transport means will bracket and carry 'along any lines extending through the slot in the table top, and force the clip against the anvil face at the second position, with the predetermined shape and orientation of the anvil face, and its location being such that the anvil will bend the ends of the clip around any line within the clip.

18. Apparatus as in claim 17 wherein said blade cutting means comprises:

a) a blade having pivoting means for pivoting the blade parallel to the table top between a first and a second angular position being located, oriented and arranged such that the blade will cut any lines extending through the slot; the pivoting means having spring means for returning the blade from the second to the first position; and b) blade operating means for engaging the pivoting means and rotating the blade between the first and the second angular position, such that the blade operating means will engage the blade pivoting means when the blade is at the first angular position, will rotate the blade to the second angular position, and will then release the blade operating means.

19. Apparatus as in claim 18 with the lower apparatus further comprising:

(a) slide means for providing motive power for the lower apparatus being attached thereto and arranged to translate parallel to the underside of the table top and parallel to the channel between its first and its second position, having slide pneumatic drive means for translating said slide means; said slide means engaging said punch such that as the slide means moves between its first and second position, the punch will move correspondingly between its first and the second position within the channel; and (b) said slide means also being arranged to engage said blade operating means as the slide means moves from the second to the first position such that the blade operating means will pivot the blade from the first to the second angular position, and will release said blade operating means as the slide moves from the first to the second position.

* * * * *